US007819271B2

(12) United States Patent
Hollis et al.

(10) Patent No.: US 7,819,271 B2
(45) **Date of Patent: *Oct. 26, 2010**

(54) DISPOSABLE CUP LID

(75) Inventors: Robert W. Hollis, Homer Glen, IL (US); Weston S. Koennecke, Oak Park, IL (US); John R. Geer, III, Downers Grove, IL (US)

(73) Assignee: Prairie Packaging, Inc., Bedford Park, IL (US)

( * ) Notice: Subject to any disclaimer, the term of this patent is extended or adjusted under 35 U.S.C. 154(b) by 255 days.

This patent is subject to a terminal disclaimer.

(21) Appl. No.: 11/559,257

(22) Filed: Nov. 13, 2006

(65) Prior Publication Data

US 2007/0095832 A1 May 3, 2007

Related U.S. Application Data

(63) Continuation-in-part of application No. 11/382,409, filed on May 9, 2006, now Pat. No. 7,691,302.

(60) Provisional application No. 60/681,851, filed on May 16, 2005.

(51) Int. Cl.
*A47G 19/22* (2006.01)
*B65D 51/18* (2006.01)
*B65D 43/20* (2006.01)

(52) U.S. Cl. ..... 220/254.5; 220/713; 220/254.3; 220/780; 229/404; 229/906.1

(58) Field of Classification Search ..... 220/254.3, 220/254.5, 713, 780; 229/404, 906.1
See application file for complete search history.

(56) References Cited

U.S. PATENT DOCUMENTS 2,184,215 A 12/1939 Geyer
2,913,140 A 11/1959 Vullemenot
3,142,411 A 7/1964 Fried et al.

(Continued)

OTHER PUBLICATIONS

Oct. 30, 2008 Office Action for U.S. Appl. No. 11/382,409.

(Continued)

*Primary Examiner*—Anthony Stashick
*Assistant Examiner*—James N Smalley
(74) *Attorney, Agent, or Firm*—K&L Gates LLP

(57) ABSTRACT

A disposable cup lid including a body and a mounting portion extending around the periphery of the body. The body defines a suitably shaped clearance area to accommodate a person's nose when drinking the contents of a cup having the lid positioned thereon. The body also defines an enhanced drinking area which is suitably configured to provide a person with a drinking experience more similar to the drinking experience of drinking from an uncovered cup or glass. In one embodiment, the body includes a raised portion which defines a lip engaging front wall and an enhanced drinking area. The enhanced drinking area includes a closure member having an upwardly extending gripping member and a drink-through opening initially covered by the closure member, wherein the drink-through opening is positioned substantially adjacent to the lip engaging front wall. The closure member is movable about a hinge from an initial closed position to an open position. The closure member of the top wall is also movable into a locking position wherein the gripping member frictionally engages the walls of a locking recess.

19 Claims, 15 Drawing Sheets

U.S. PATENT DOCUMENTS

| | | | |
|---|---|---|---|
| 3,302,858 | A | 2/1967 | Miller |
| 3,387,765 | A | 6/1968 | Davis |
| 3,596,792 | A | 8/1971 | Wilcox |
| 3,777,968 | A | 12/1973 | Law |
| 3,860,162 | A | 1/1975 | Schutz |
| 3,952,910 | A | 4/1976 | Wheeler |
| RE28,797 | E | 5/1976 | Brewer |
| 3,977,559 | A | 8/1976 | Lombardi |
| 3,977,562 | A | 8/1976 | Wedzik |
| 3,994,411 | A | 11/1976 | Elfelt et al. |
| 4,056,210 | A | 11/1977 | Boyle |
| 4,090,660 | A | 5/1978 | Schram et al. |
| 4,106,660 | A | 8/1978 | Boyle |
| 4,113,135 | A | 9/1978 | Yamazki |
| 4,138,033 | A | 2/1979 | Payne et al. |
| 4,164,303 | A | 8/1979 | Waterburg |
| 4,184,604 | A | 1/1980 | Amberg et al. |
| 4,186,842 | A | 2/1980 | Albert |
| 4,187,954 | A | 2/1980 | Striggow |
| 4,190,174 | A | 2/1980 | Haimowitz |
| 4,202,459 | A | 5/1980 | DeParales et al. |
| 4,210,272 | A | 7/1980 | Sequin |
| 4,243,156 | A | 1/1981 | Lobbestael |
| D259,403 | S | 6/1981 | Frazier, Jr. |
| 4,285,442 | A | 8/1981 | Wedzik |
| 4,319,691 | A | 3/1982 | Hament |
| 4,319,692 | A | 3/1982 | Gundlach |
| 4,322,015 | A | 3/1982 | Bailey |
| 4,345,695 | A | 8/1982 | Galloway et al. |
| D267,633 | S | 1/1983 | Christian |
| 4,377,244 | A | 3/1983 | Rossetti |
| 4,412,629 | A | 11/1983 | Dart et al. |
| D271,857 | S | 12/1983 | Callahan |
| 4,421,244 | A | 12/1983 | Van Melle |
| 4,438,865 | A | 3/1984 | Scattaregia |
| 4,441,624 | A | 4/1984 | Sokolowski |
| D274,502 | S | 7/1984 | Little |
| 4,460,103 | A | 7/1984 | Rama et al. |
| RE31,650 | E | 8/1984 | Serritella |
| D274,983 | S | 8/1984 | Dart et al. |
| 4,473,167 | A | 9/1984 | Bailey |
| 4,489,848 | A | 12/1984 | Braude |
| 4,502,608 | A | 3/1985 | Mills |
| 4,513,502 | A | 4/1985 | Gacek |
| 4,518,096 | A | 5/1985 | Winstead |
| 4,566,605 | A | 1/1986 | Rogers |
| 4,582,214 | A | 4/1986 | Dart et al. |
| 4,589,569 | A | 5/1986 | Clements |
| D285,416 | S | 9/1986 | Dart et al. |
| 4,615,459 | A | 10/1986 | Clements |
| 4,627,537 | A | 12/1986 | Rogers |
| 4,629,088 | A | 12/1986 | Durgin |
| D287,919 | S | 1/1987 | Clements |
| 4,738,373 | A | 4/1988 | DeParales |
| 4,741,450 | A | 5/1988 | Braude |
| 4,753,365 | A | 6/1988 | Seppala |
| 4,756,440 | A | 7/1988 | Gartner |
| 4,760,934 | A | 8/1988 | Netsch |
| 4,934,558 | A | 6/1990 | Vargas |
| 4,938,379 | A | 7/1990 | Kellner |
| 4,949,865 | A | 8/1990 | Turner |
| 4,953,743 | A | 9/1990 | Dart et al. |
| 5,050,759 | A | 9/1991 | Marble |
| D323,116 | S | 1/1992 | Dart et al. |
| 5,090,584 | A | 2/1992 | Roberts et al. |
| 5,111,961 | A | 5/1992 | Van Melle |
| 5,165,579 | A | 11/1992 | Lund |
| 5,183,172 | A | 2/1993 | Boller |
| 5,197,624 | A | 3/1993 | Dodaro |
| 5,253,781 | A | 10/1993 | Van Melle et al. |
| 5,335,812 | A | 8/1994 | Boller |
| 5,348,181 | A | 9/1994 | Smith et al. |
| D353,769 | S | 12/1994 | Miller |
| D354,438 | S | 1/1995 | Miller |
| 5,392,949 | A | 2/1995 | McKenna |
| 5,398,843 | A | 3/1995 | Warden et al. |
| D360,133 | S | 7/1995 | Boller |
| 5,451,356 | A | 9/1995 | Hebert |
| 5,490,609 | A | 2/1996 | Lane et al. |
| 5,503,289 | A | 4/1996 | Fox |
| 5,509,568 | A | 4/1996 | Warden et al. |
| D372,866 | S | 8/1996 | Ahern, Jr. |
| D374,590 | S | 10/1996 | Ahern, Jr. |
| D374,794 | S | 10/1996 | Ahern, Jr. |
| 5,613,619 | A | 3/1997 | Van Melle |
| 5,624,053 | A | 4/1997 | Freek et al. |
| 5,699,927 | A | 12/1997 | Lane et al. |
| 5,706,972 | A | 1/1998 | Sousa |
| D390,465 | S | 2/1998 | Frye |
| 5,722,558 | A | 3/1998 | Thompson |
| D394,184 | S | 5/1998 | Damore |
| 5,798,079 | A | 8/1998 | Freek et al. |
| 5,820,016 | A | 10/1998 | Stropkay |
| 5,839,601 | A | 11/1998 | Van Melle |
| D402,556 | S | 12/1998 | Frye |
| D405,011 | S | 2/1999 | DeCoster et al. |
| 5,894,950 | A | 4/1999 | Kick |
| 5,894,952 | A | 4/1999 | Mendenhall et al. |
| 5,911,331 | A | 6/1999 | Boller |
| 5,947,323 | A | 9/1999 | Freek et al. |
| D416,170 | S | 11/1999 | Stucke, Jr. et al. |
| 5,979,647 | A | 11/1999 | Han |
| D417,845 | S | 12/1999 | Sadlier et al. |
| 5,996,837 | A | 12/1999 | Freek et al. |
| D418,363 | S | 1/2000 | Barnes et al. |
| 6,076,450 | A | 6/2000 | DiGiorgio, Jr. |
| 6,079,588 | A | 6/2000 | Khafizov |
| 6,089,397 | A | 7/2000 | Van Melle |
| 6,176,390 | B1 | 1/2001 | Kemp |
| 6,209,748 | B1 | 4/2001 | Dunbar |
| 6,220,470 | B1 | 4/2001 | McHenry et al. |
| 6,260,727 | B1 | 7/2001 | Durdon |
| D447,412 | S | 9/2001 | Durdon |
| 6,398,083 | B2 | 6/2002 | Nybakke |
| D461,361 | S | 8/2002 | Orr et al. |
| 6,505,753 | B1 | 1/2003 | Freek et al. |
| D470,009 | S | 2/2003 | Turchi et al. |
| 6,533,139 | B2 | 3/2003 | Lukacevic |
| 6,571,973 | B1 | 6/2003 | Tripsianes |
| D476,566 | S | 7/2003 | Smith et al. |
| D476,567 | S | 7/2003 | Weiss et al. |
| D476,891 | S | 7/2003 | Clarke et al. |
| D477,223 | S | 7/2003 | Smith et al. |
| D478,006 | S | 8/2003 | Smith et al. |
| D479,802 | S | 9/2003 | Arduini |
| 6,612,456 | B1 * | 9/2003 | Hundley et al. ..... 220/254.3 |
| D480,968 | S | 10/2003 | Atkins et al. |
| D481,633 | S | 11/2003 | Schmidtner et al. |
| 6,644,490 | B2 | 11/2003 | Clarke |
| D485,758 | S | 1/2004 | Clarke et al. |
| D485,759 | S | 1/2004 | Janky et al. |
| 6,679,397 | B2 | 1/2004 | Smith et al. |
| D487,399 | S | 3/2004 | Schmidtner et al. |
| 6,702,145 | B2 | 3/2004 | Malcolm |
| D489,260 | S | 5/2004 | Smith et al. |
| 6,732,875 | B2 | 5/2004 | Smith et al. |
| D493,718 | S | 8/2004 | Durdon |
| 6,811,049 | B2 | 11/2004 | Lukacevic |
| 6,824,003 | B1 | 11/2004 | Wong |
| 6,874,649 | B2 | 4/2005 | Clarke et al. |
| 6,886,707 | B2 | 5/2005 | Giraud |
| 6,889,859 | B1 | 5/2005 | Leon |
| 6,889,860 | B2 | 5/2005 | Mazzarolo |
| 6,905,044 | B1 | 6/2005 | Russo et al. |

| | | | |
|---|---|---|---|
| 6,929,143 | B2 | 8/2005 | Mazzarolo |
| 6,932,231 | B2 | 8/2005 | Haynes et al. |
| 6,948,633 | B2 | 9/2005 | Freek et al. |
| D514,444 | S | 2/2006 | Smith et al. |
| D514,445 | S | 2/2006 | Smith et al. |
| D516,424 | S | 3/2006 | Schweigert et al. |
| D516,910 | S | 3/2006 | Bresler |
| D516,912 | S | 3/2006 | LaMasney |
| D516,913 | S | 3/2006 | LaMasney |
| D522,860 | S | 6/2006 | LaFortune |
| 7,063,224 | B2 | 6/2006 | Clarke et al. |
| 7,080,916 | B1 | 7/2006 | Ferrin et al. |
| 7,100,787 | B2 | 9/2006 | Farnsworth et al. |
| 7,100,790 | B2 | 9/2006 | Dark |
| 7,111,749 | B1 | 9/2006 | Akers |
| D530,602 | S | 10/2006 | Boller et al. |
| D531,033 | S | 10/2006 | Schmidtner et al. |
| 7,134,556 | B1 | 11/2006 | McCauley |
| 7,134,566 | B2 | 11/2006 | Smith et al. |
| D533,777 | S | 12/2006 | Hundley et al. |
| D533,778 | S | 12/2006 | Hollis et al. |
| D533,779 | S | 12/2006 | Schmidtner et al. |
| 7,147,126 | B2 | 12/2006 | Samson et al. |
| D535,561 | S | 1/2007 | Smith et al. |
| D535,877 | S | 1/2007 | Tanninen et al. |
| 7,156,251 | B2 | 1/2007 | Smith et al. |
| 7,159,732 | B2 | 1/2007 | Smith et al. |
| D536,249 | S | 2/2007 | Smith et al. |
| 7,175,042 | B2 | 2/2007 | Durdon |
| 7,175,043 | B2 | 2/2007 | O'Neal |
| D537,717 | S | 3/2007 | Notarianni |
| 7,185,781 | B2 | 3/2007 | Pitts |
| 7,191,911 | B2 | 3/2007 | O'Neill |
| 7,195,130 | B2 | 3/2007 | Pendergrass et al. |
| D539,649 | S | 4/2007 | Smith et al. |
| D539,650 | S | 4/2007 | Smith et al. |
| D540,167 | S | 4/2007 | Smith et al. |
| 7,484,638 | B2 | 2/2009 | Mazzarolo |
| 2002/0027139 | A1 | 3/2002 | O'Neill |
| 2002/0038803 | A1 | 4/2002 | Malcolm |
| 2003/0024929 | A1 | 2/2003 | Smith et al. |
| 2003/0024930 | A1 | 2/2003 | Smith et al. |
| 2003/0052127 | A1 | 3/2003 | Mazzarolo |
| 2003/0089714 | A1 | 5/2003 | Dart et al. |
| 2003/0089726 | A1 | 5/2003 | Mazzarolo |
| 2003/0102312 | A1 | 6/2003 | Horner |
| 2003/0116568 | A1 | 6/2003 | Clarke et al. |
| 2003/0178426 | A1 | 9/2003 | Freek et al. |
| 2003/0192890 | A1 | 10/2003 | Mazzarolo |
| 2003/0197012 | A1 | 10/2003 | Smith et al. |
| 2003/0218017 | A1 | 11/2003 | Schmidtner et al. |
| 2004/0035868 | A1 | 2/2004 | Smith et al. |
| 2004/0089662 | A1 | 5/2004 | Smith et al. |
| 2004/0118847 | A1 | 6/2004 | Giraud |
| 2004/0195239 | A1 | 10/2004 | Rush et al. |
| 2005/0092748 | A1 | 5/2005 | Durdon |
| 2005/0092749 | A1 | 5/2005 | Durdon |
| 2005/0127075 | A1 | 6/2005 | Smith et al. |
| 2005/0155969 | A1 | 7/2005 | Clarke et al. |
| 2005/0155973 | A1 | 7/2005 | Goeking et al. |
| 2005/0173434 | A1 | 8/2005 | O'Neal |
| 2005/0173443 | A1 | 8/2005 | Crudgington et al. |
| 2005/0205588 | A1 | 9/2005 | Pitts |
| 2005/0224505 | A1 | 10/2005 | Brown et al. |
| 2005/0230406 | A1 | 10/2005 | Maravich et al. |
| 2006/0027588 | A1 | 2/2006 | Mackovic-Basic et al. |
| 2006/0060590 | A1 | 3/2006 | Goeking |
| 2006/0071008 | A1 | 4/2006 | Sadlier |
| 2006/0081633 | A1 | 4/2006 | Schmidtner et al. |
| 2006/0096983 | A1 | 5/2006 | Patterson |
| 2006/0163251 | A1 | 7/2006 | Kelstrom et al. |
| 2006/0180028 | A1 | 8/2006 | Burchard |
| 2006/0180593 | A1 | 8/2006 | White |
| 2006/0201945 | A1 | 9/2006 | Tedford, Jr. |
| 2006/0213908 | A1 | 9/2006 | Clarke et al. |
| 2006/0226147 | A1 | 10/2006 | Phillips |
| 2006/0226148 | A1 | 10/2006 | Hundley et al. |
| 2006/0255037 | A1 | 11/2006 | Hollis et al. |
| 2006/0255043 | A1 | 11/2006 | Tedford |
| 2006/0261068 | A1 | 11/2006 | Schmidtner et al. |
| 2006/0273093 | A1 | 12/2006 | Portman et al. |
| 2007/0034629 | A1 | 2/2007 | Mazzarolo |
| 2007/0045316 | A1 | 3/2007 | Arnljots |
| 2007/0075080 | A1 | 4/2007 | Farnsworth et al. |

OTHER PUBLICATIONS

Apr. 10, 2009 Office Action for U.S. Appl. No. 11/382,409.
Sep. 2, 2009 Office Action for U.S. Appl. No. 11/382,409.

* cited by examiner

DISPOSABLE CUP LID

PRIORITY CLAIM

This application is a continuation-in-part application of, claims priority to and the benefit of U.S. patent application Ser. No. 11/382,409, filed May 9, 2006, which is a non-provisional application of, claims priority to and the benefit of U.S. Provisional Patent Application No. 60/681,851, filed May 16, 2005, the entire contents of which are incorporated herein.

CROSS-REFERENCE TO RELATED APPLICATIONS

This application relates to the following co-pending commonly owned patent applications: "DISPOSABLE CUP LID," Ser. No. 11/382,398, "DISPOSABLE CUP LID," Ser. No. 29/248,892, "DISPOSABLE CUP LID," Ser. No. 29/248,889, "DISPOSABLE CUP LID," Ser. No. 29/248,885, "DISPOSABLE CUP LID," Ser. No. 29/248,882, "DISPOSABLE CUP LID," Ser. No. 29/248,886, "DISPOSABLE CUP LID," Ser. No. 29/248,883, "DISPOSABLE CUP LID," Ser. No. 29/248,888, "DISPOSABLE CUP LID," Ser. No. 29/248,891, "DISPOSABLE CUP LID," Ser. No. 29/248,898, "DISPOSABLE CUP LID," Ser. No. 29/248,896, "DISPOSABLE CUP LID," Ser. No. 29/250,408, and "DISPOSABLE CUP LID," Ser. No. 29/250,410,

BACKGROUND

The use of disposable cup lids on disposable, single use hot drink cups has been known for many years. In the North American markets alone, every day literally millions of such disposable cups and cup lids are distributed by fast food restaurants, coffee shops and convenience stores for single use purposes. These cups and cup lids are usually disposed of after the single use.

Generally, these lids permit the beverages to be consumed while reducing the likelihood of spillage of the beverages contained within these cups. Such spillage may occur accidentally, such as by simple clumsiness on the part of the person handling the cup or by exposure to other causes, such as the result of a rough vehicle ride or the attempt by a person to walk or run while holding the cup. While a fully closed lid prevents substantial spilling, many people also desire to drink from the cups without removing the lid entirely. Therefore, various different cup lids have been made or proposed which allow people to drink the beverages in the cups without completely opening or removing the lids.

One such type of lid includes a small openable portion. This feature limits exposure of the beverage to ambient conditions and reduces the area through which the beverage may spill while still allowing a person to drink the beverage in the cup. The openable portion is usually recloseable, at least in theory.

However, the openable portion often interferes with a person's ability to drink the beverage. That is, the openable portion generally extends upwardly above a central region of the cup lid and often interferes with the upper lip or nose of a person consuming a beverage from a cup on which the cup lid is placed. Additionally, the openable portion associated with such a cup lid sometimes does not stay in its secured open position, often releasing from its secured position while a person is drinking. Moreover, the angle of the opening of such lids do not comfortably conform to a person's mouth and/or lips in a manner that easily facilitates consumption of a beverage. These concerns may result in a decision by a person to decide to discard the cup lid in its entirety, which in turn leads to faster cooling of the hot drink and an increased risk of spillage.

Another type of lid includes a small fixed opening through which a person drinks the beverage. While these lids minimize spillage, because of the small sizing of the opening, these lids must be removed from the cup in order to add condiments, such as milk, cream and/or sugar, to the beverage contained in the cup. Such a removal of the lid increases the risk of spillage when the condiments are being added, when the lid is being resecured to the cup or if the lid is not properly resecured to the lid.

Accordingly, a need exists to provide a disposable drinking cup lid which prevents spillage of the contents of the drinking cup while providing an enhanced drinking experience.

SUMMARY

The present disclosure relates in general to a container lid, and more particularly to a disposable cup lid and a method of manufacturing the disposable cup lid.

In one embodiment, the disposable cup lid includes a body and a mounting portion extending around the periphery of the body. The lid is suitably sized to be attached to a drinking cup. The body completely covers the open end of the drinking cup when the lid is attached to the cup. The body defines a suitably shaped clearance area to accommodate a person's nose when drinking the contents of a cup having the lid positioned thereon. The body also defines an enhanced drinking area which is suitably configured to provide a person with a drinking experience more similar to the drinking experience of drinking from an uncovered cup or glass.

More specifically, the body of the lid includes a floor and a raised portion extending upwardly from the floor. The raised portion which defines the clearance area and the enhanced drinking area includes a lip engaging front wall or lip engager, a rear wall, two spaced apart side walls and a top wall connected to and extending from the top edges of the lip engaging front wall, rear wall and side walls. The floor and these walls are preferably integrally formed. In one embodiment, the lip engaging front wall is curved, annular or radiused in a first or horizontal direction and in a second or vertical direction to provide a comfortable surface for the person's bottom lip as further discussed below. In one embodiment, the lip engaging front wall is offset from a perpendicular plane at an angle in the range of greater than 0 degrees to 30 degrees, and in one preferred embodiment at an angle of approximately 21 degrees.

The top wall of the raised portion includes a front section, a central section and a rear section. The front section of the top wall includes a movable or pivotable closure member or tear-back flap. The front section of the top wall defines a drink-through opening which, as described in more detail below, is initially covered by the closure member. In one embodiment, the closure member includes a gripping member which enables a person to more easily open the closure member and move the closure member from an initially closed position to a locked or secured open position. The gripping member also enables a person to more easily move the closure member from the locked open position to a secured closed position. The central section of the top wall defines a locking recess configured to secure the gripping member and to securely hold the gripping member (and thus the closure member) in the locked open position. One embodiment of the rear section of the top wall defines at least one branding area.

In one embodiment, the front section, central section and rear section of the top wall define the clearance area which is substantially concave in shape. As described above, the substantially concave shaped clearance area provides additional clearance to accommodate a person's nose when the person is drinking the beverage in a cup having the lid positioned thereon. This provides an enhanced drinking experience over other lids with top surfaces which lie substantially in a single horizontal plane and wherein an average sized person's nose may contact the top surface of the lid when the cup and lid are in the drinking position.

In an alternative embodiment, the central section and rear section of the top wall are substantially flat in shape (or otherwise lie substantially in a single horizontally extending or substantially horizontally extending plane).

In one embodiment, a front part of the clearance area defines at least part of the enhanced drinking area. In one embodiment, the enhanced drinking area is offset from a horizontal plane at an angle in the range of greater than 0 degrees to 45 degrees, and in one preferred embodiment at an angle of approximately 13.5 degrees. The enhanced drinking area also includes the closure member or tear-back flap (including the gripping member) and the drink-through opening. The enhanced drinking area is configured such that a first location of the enhanced drinking area positioned closer to the lip engaging front wall resides in a relatively higher plane than a second location of the enhanced drinking area positioned further from the lip engaging front wall. It should be appreciated that by providing a receding spout configuration with the closure member (including the gripping member) and drink-through opening suitably angled or sloped relative to or intersecting a horizontal plane, the disposable cup provides a more natural and uninhibited drinking experience for a person while also minimizing beverage spillage problems. For example, providing the drink-through opening at or near the highest plane of the lid, maximizes the area of the lip engaging front wall and thus maximizes the amount of contact between the person's lower lip and the lid. Such maximized contact more closely mimics the person's experience of drinking from an uncovered cup or glass.

In one embodiment, the closure member includes a base which is defined by a hinge formed in the top wall, two spaced apart perforated sides or edges and a third perforated side edge which joins the outer ends of the first and second perforated sides or edges. The top wall is suitably beveled from a top surface to the perforated sides as described in more detail below. The closure member is movable or pivotable about the hinge from the initial closed position to the locked open position as discussed above. The closure member of the top wall is also pivotable from the locked open position to the secured closed position as discussed above. In operation, when the closure member is in the open position, the front section of the top wall defines the drink-through opening wherein the hinge, the two spaced apart perforated sides or edges and the third perforated front side or edge define the periphery of the drink-through opening. In one embodiment, the drink-through opening is suitably sized to enable a person to add one or more condiments (such as creamers and sweeteners) to the beverage in the cup without needing to remove the lid from the cup.

In one embodiment, the first and second perforated sides or edges of the closure member are suitably shaped such that a portion of the width of the closure member narrows as the closure member extends toward the lip engaging front wall (i.e., in the direction of the periphery of the lid). This narrowing shape of the closure member (and the subsequently exposed drink-through opening) funnels more of the beverage into the center of the drinker's mouth to further enhance a person's drinking experience.

In one embodiment, the gripping member is suitably shaped to allow a person's thumb and finger to engage the gripping member to catch and lift the gripping member (and the closure member) into the open position. It should be appreciated that positioning the gripping member at an angle or relative to or intersecting the horizontally situated rim of the cup, when compared to gripping members of known lids (i.e., which sit in a substantially horizontal plane), provides a person with increased leverage when lifting the gripping member (and the connected closure member).

The locking recess of the raised portion is defined by a pair of spaced apart side or locking walls and in one embodiment a concave shaped floor or bottom wall. In one embodiment, the side walls are suitably angled such that the width between the side walls of the locking recess decreases in a direction toward the floor of the locking recess until the width between the side walls is equal to or less than the width between two side walls of the gripping member. In this embodiment, when the closure member is folded back about the hinge, the gripping member engages the locking recess and the side walls of the locking recess frictionally engage the side walls of the gripping member. This frictional engagement ensures that the gripping member and the entire closure member remains secured in the locking recess and thus the closure member remains in the locked open position until unlocked by a person.

In one embodiment, the rear section of the top wall is offset from a horizontal plane at an angle in the range of greater than 0 degrees to 60 degrees, and in one preferred embodiment at an angle of approximately 15 degrees. The branding zone or area of the rear section provides an area where suitable indicia, such as a company's logo, may be placed or stamped onto the disposable lid. Placing the indicia on a sloped surface provides that such indicia is more easily viewed not only when the lid is situated on a horizontal plane but also when a person is drinking from a cup with the lid attached.

In one embodiment, the lid is disposable and vacuum and/or pressure formed from any suitable plastic material such as extruded polystyrene or polypropylene. In this embodiment, a thin sheet of the plastic material is extruded, reheated and conveyed into a vacuum/pressure molding station where the plastic material is vacuum/pressure molded using male or female cavities or molds. The plastic sheet material is permitted to cool for a brief period of time and then stripped or removed from the cavity or mold.

After the web or sheet material has been stripped or removed from the cavity or mold, the web or sheet material is conveyed to a trimming station where perforated fault lines are stamped in the lid to define the closure member or tear-back flap. In one embodiment, if the pre-stamped lid sits in a substantially horizontal plane, then the blade and corresponding strike plate which are used to stamp the perforated lines must be suitably angled relative to a perpendicular plane to correspond with the angle or slope defined by the enhanced drinking area in the front section of the top wall. In another embodiment, if the pre-stamped lid is situated at an angle which corresponds with the angle or slope defined by the enhanced drinking area, then a substantial horizontal blade and corresponding substantial horizontal strike plate may be used to stamp the perforated lines into the lid. At the same time or in a separate cutting step, the web or sheet material is stamped so as to cut or trim the lids from the sheet material and to cut any venting holes into the lid.

It is therefore an advantage of the present apparatus and method to provide a disposable drinking cup lid with a raised portion which defines suitably configured front and top surfaces which enhance a person's drinking experience.

A further advantage of the present apparatus and method is to provide a disposable drinking cup lid which defines a suitably shaped clearance area to accommodate a person's nose when drinking the contents of a cup having the lid positioned thereon.

A further advantage of the present apparatus and method is to provide a disposable drinking cup lid having a designated area in which indicia may be placed and readily viewed.

A further advantage of the present apparatus and method is to provide a disposable drinking cup lid with a drink-through opening suitably shaped to funnel the contents of the drinking cup into the center of a person's mouth.

A further advantage of the present apparatus and method is to provide a disposable drinking cup lid with a drink-through opening suitably sized to enable a person to add one or more condiments to the cup without removing the lid.

Another advantage of the present apparatus and method is to provide a disposable drinking cup lid with a gripping member suitably shaped to provide increased leverage for a person when opening the closure member as well as when reclosing the closing member.

Additional features and advantages are described in, and will be apparent from, the following Detailed Description and the figures.

DETAILED DESCRIPTION

The present disclosure relates in general to a container lid and more particularly to a lid for a drinking cup and a method of manufacturing the same. The lid may be used with cups of various different types and sizes, and is particularly suitable for use with disposable cups of the type commonly used as carry-out containers for beverages such as coffee, tea and soup. Such drinking cups usually define a circular top opening or aperture and have a generally circular upper lip or rim which lies in a single plane and is formed for receiving and having a lid secured thereon.

Referring now to FIGS. 1 to 7, one embodiment of the container lid is illustrated and generally indicated by numeral 10. In one embodiment, the lid 10 is formed from a disposable, recyclable material, however any suitable material may be used to form the lid 10. In one embodiment, the lid 10 is generally circular in configuration to conform to circular cups, however the lid may be suitably shaped to conform to any suitably shaped cup. The lid 10 includes a body 12 and an annular mounting portion 14 extending around the periphery of the body 12. The mounting portion 14 is suitably configured to engage the upper lip or rim of a drinking cup (not shown). The body 12 completely covers the opening of the drinking cup to inhibit spillage and reduce heat transfer between the beverage and the surrounding atmosphere when the lid 10 is in place.

Figure 12:
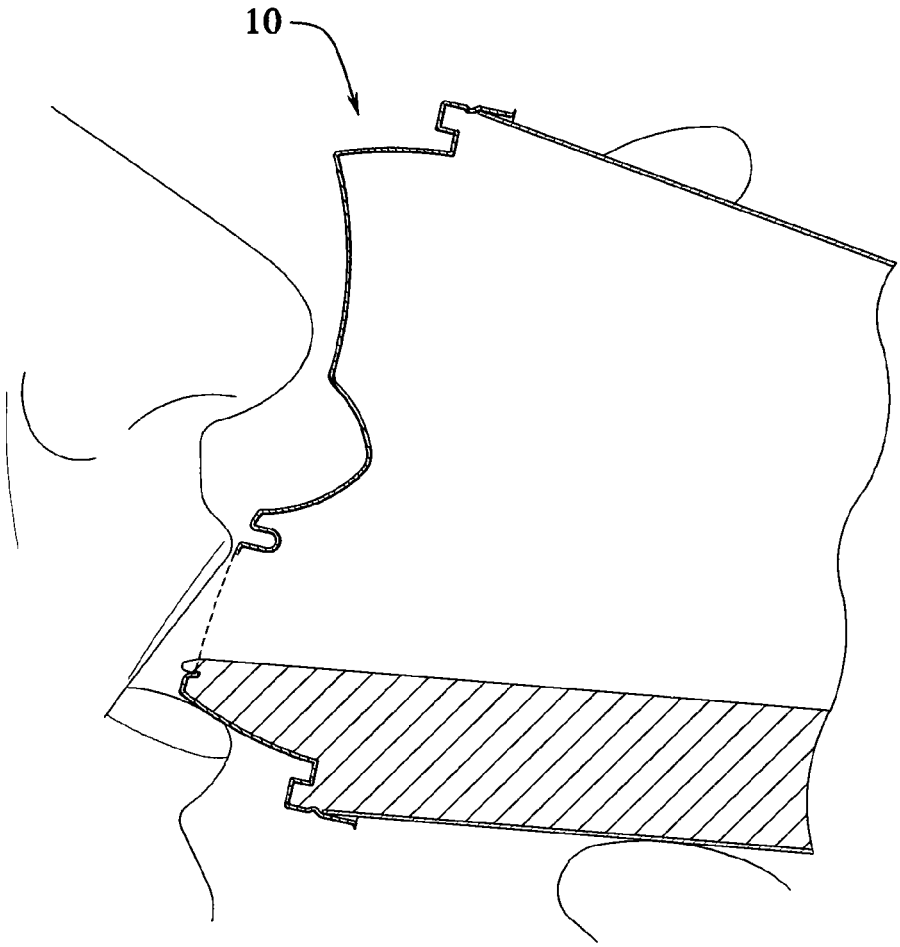
FIG. 12 is a schematic side view of one embodiment of the cup lid and a fragmentary view of a person's face, and illustrating the contour of the clearance area defining the suitable space for a person's nose while drinking the beverage in the cup.

The body 12 includes a floor or base 16 and a raised portion 18 which is offset from the periphery of the lid and extends upwardly from the floor. The raised portion 18 of the body 12 includes a lip engaging front wall or lip engager 28, a rear wall 30 and two spaced apart side walls 32. The lip engaging front wall or lip engager 28 is the area where the lower lip of a person or drinker is positioned when consuming a beverage as shown in FIG. 12. This wall serves the same purpose as the outer surface of a cup or glass during a normal drinking process. In one embodiment, the lip engaging front wall 28 extends from the floor 16 of the lid 10 to a height in the range of half an inch to one inch, and in one preferred embodiment to a height of approximately 0.61 inches. Such a height maximizes the area of the lip engaging front wall 28 and thus a person's lower lip is provided maximum contact with the lid.

Figure 1:
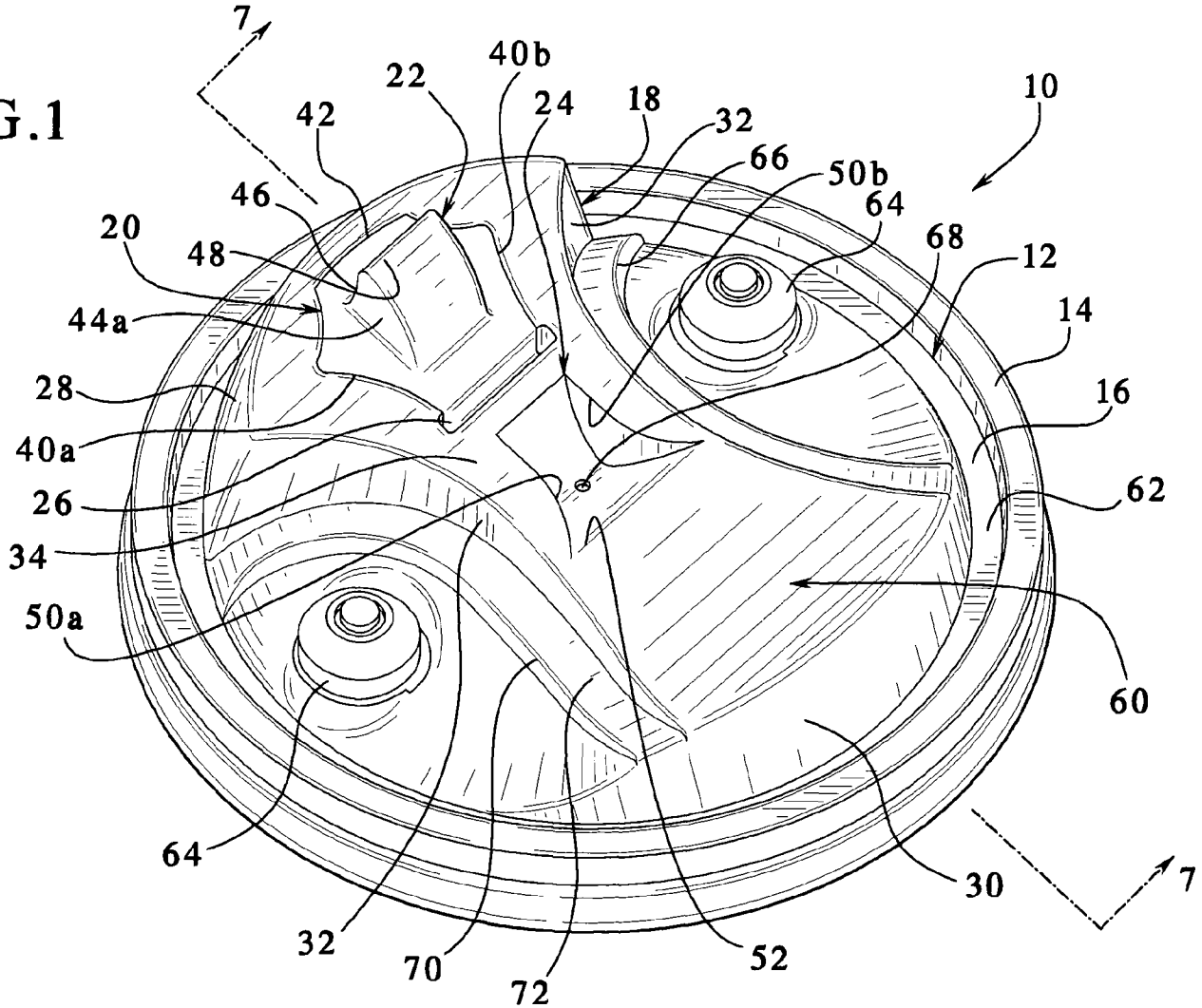
FIG. 1 is a rear perspective view of one embodiment of the disclosed cup lid.
Figure 2A:
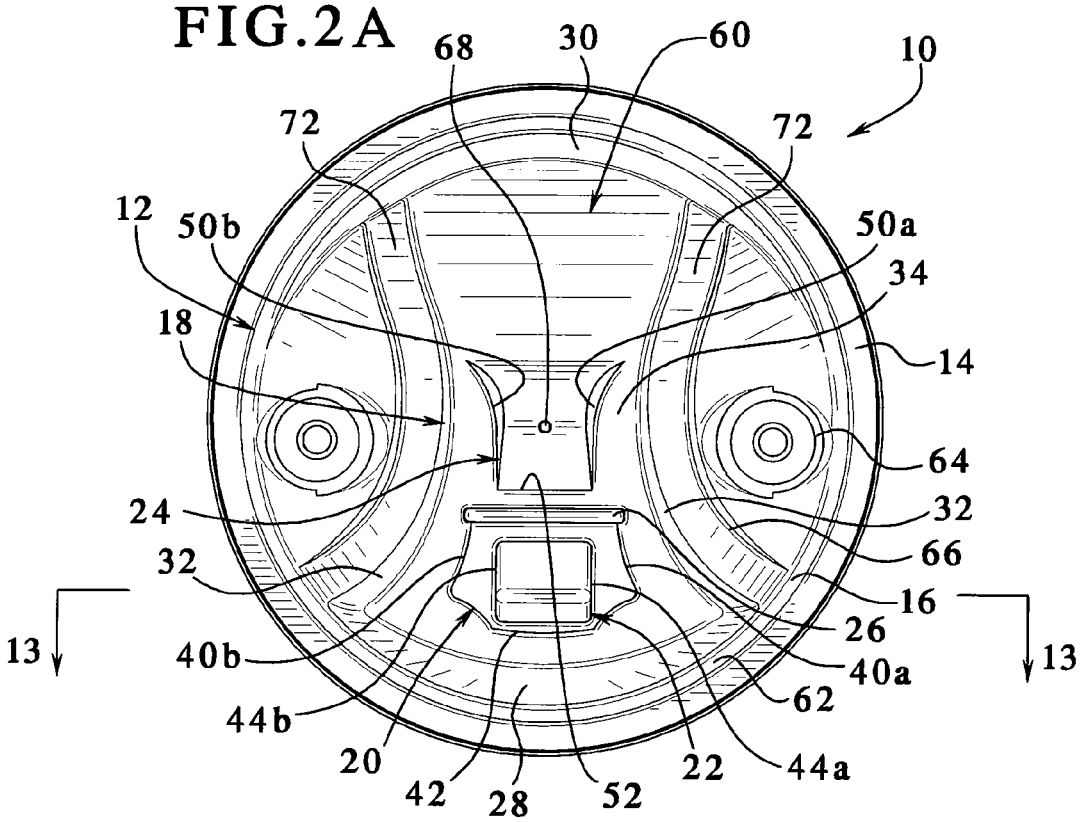
FIG. 2A is a top plan view of the embodiment of the cup lid of FIG. 1, and illustrating the closure member in an initially closed position.
Figure 2B:
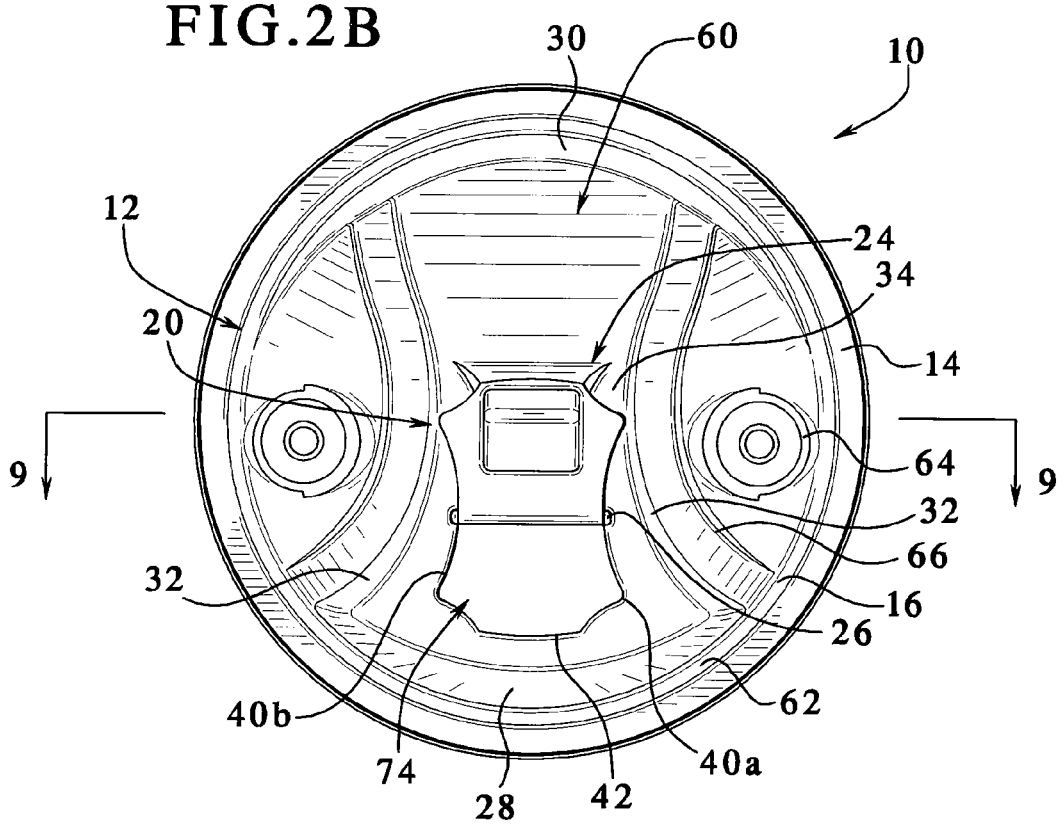
FIG. 2B is a top plan view of the embodiment of the cup lid of FIG. 1, and illustrating the closure member in a locked open position to reveal a drink-through opening.
Figure 3:
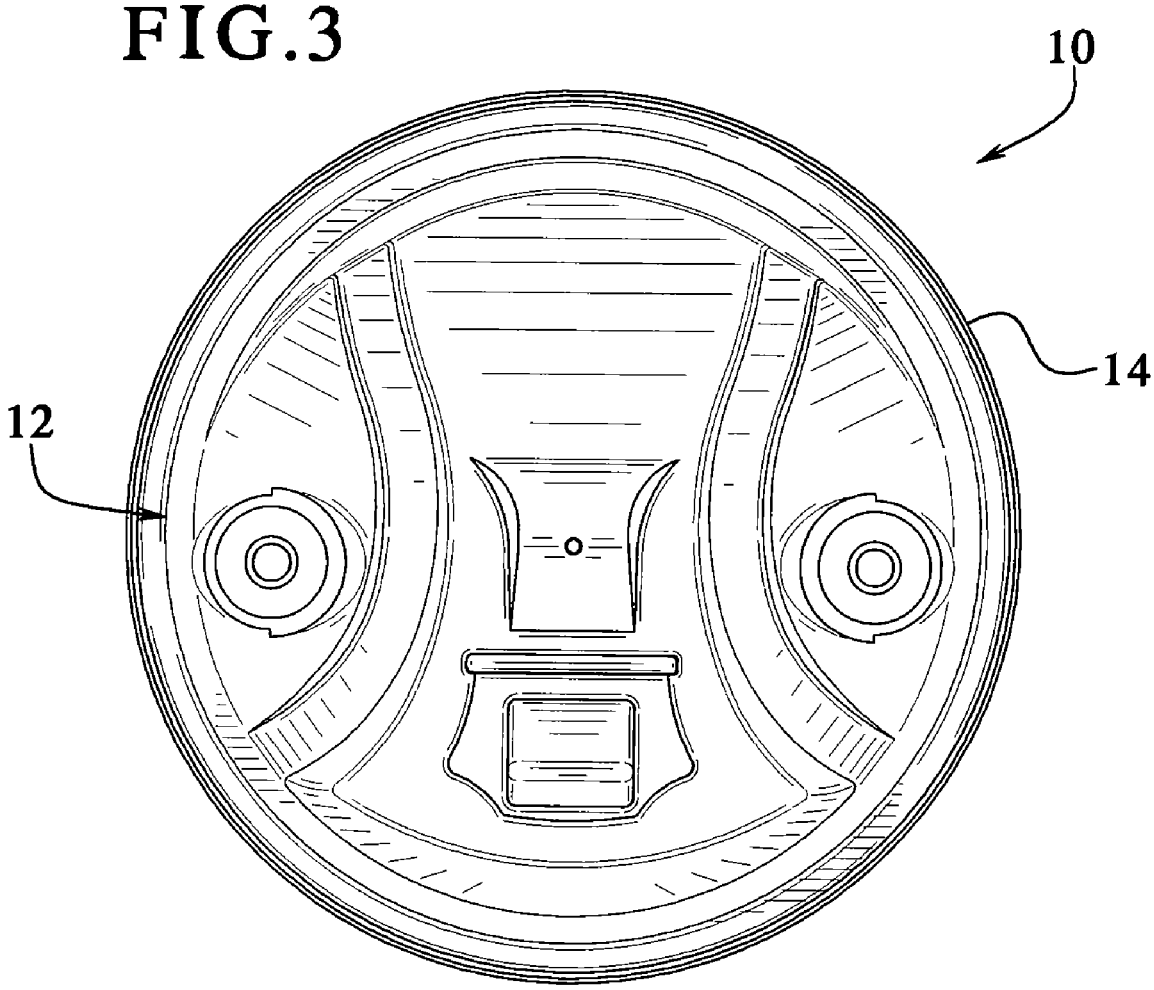
FIG. 3 is a bottom plan view of the embodiment of the cup lid illustrated in FIG. 1.
Figure 4:
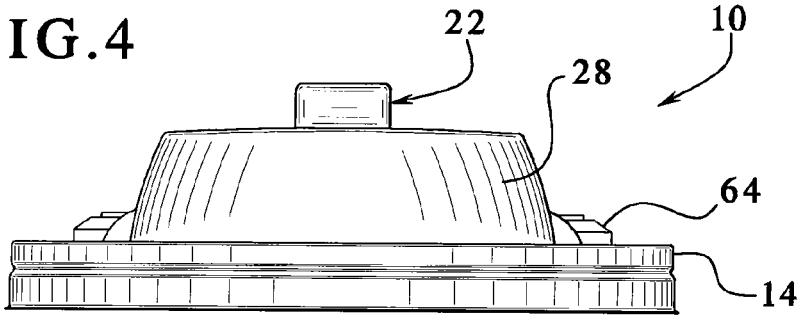
FIG. 4 is a front side view of the embodiment of the cup lid illustrated in FIG. 1.
Figure 5:
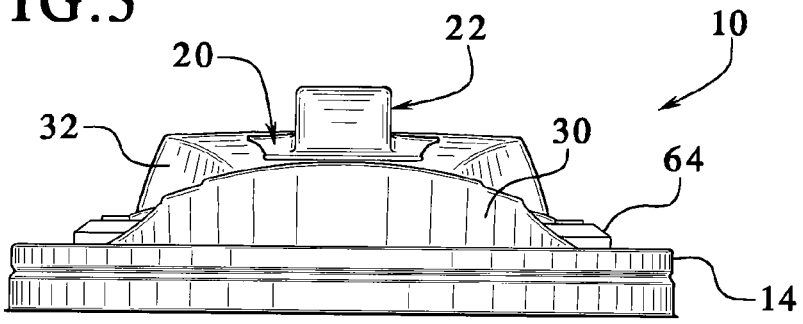
FIG. 5 is a rear side view of the embodiment of the cup lid illustrated in FIG. 1.
Figure 7:
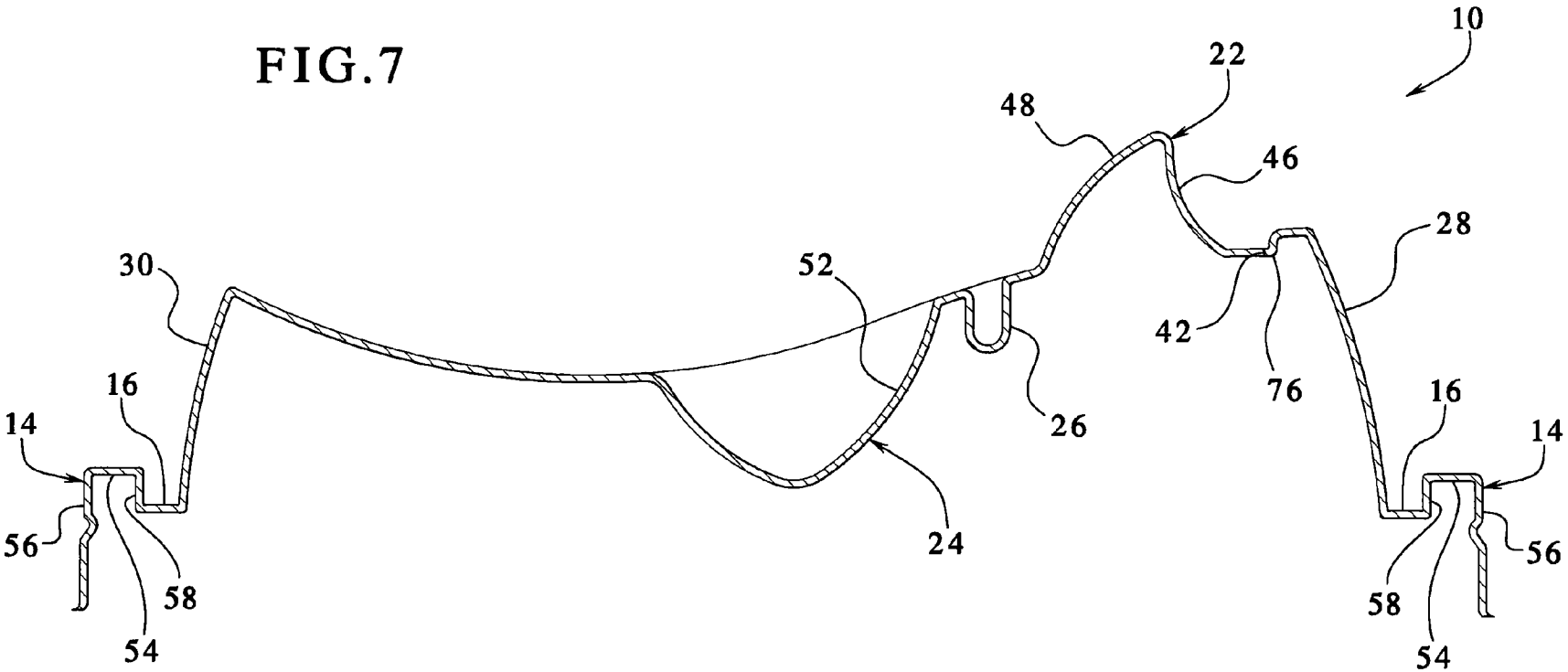
FIG. 7 is a cross-sectional side view of one embodiment of the cup lid taken substantially through line 7-7 of FIG. 1, and illustrating the closure member in the initial closed position.
Figure 19:
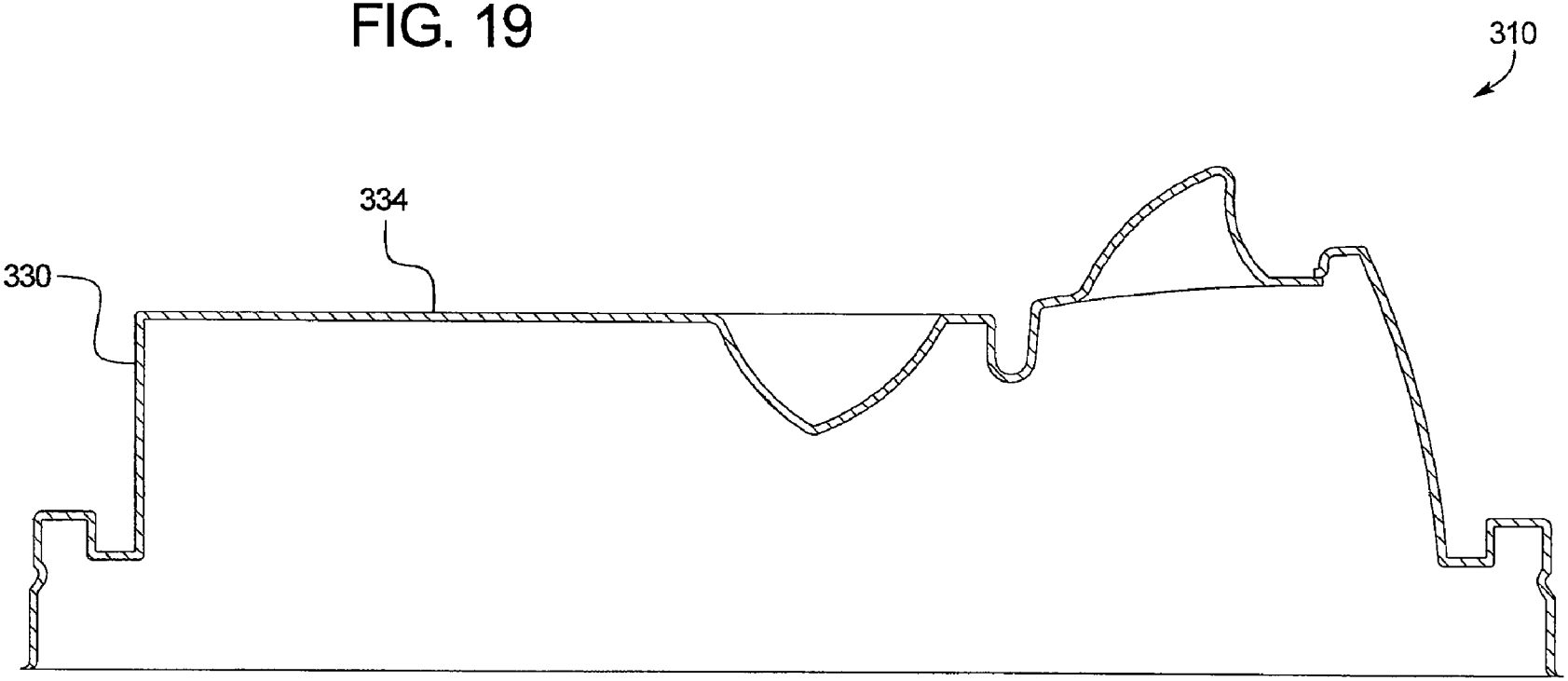
FIG. 19 is a cross-sectional side view of an alternative embodiment of the cup lid illustrating the closure member in the initial closed position.

As best seen in FIGS. 1, 2A and 2B, the raised portion 18 also includes a top wall 34 connected to and extending from the top edges of the lip engaging front wall 28, the rear wall 30 and the two sides walls 32. In one embodiment (as best seen in FIG. 7), the top wall 34 and the lip engaging front wall 28 are connected at an acute angle. In another embodiment, the top wall 34 and the lip engaging front wall 28 extend outward from each other at an acute angle. In one embodiment, the top wall 34 and the rear wall 30 are connected at an acute angle. In another embodiment, the top wall 34 and the rear wall 30 extend outward from each other at an acute angle. In another embodiment, as best seen in the disposable cup lid 310 of FIG. 19, the top wall 334 extends from the rear wall 330 at a right angle. In one embodiment, the acute angle defined by the top wall and the front wall is the same as the acute angle defined by the top wall and the rear wall. In another embodiment, the acute angle defined by the top wall and the front wall is different than the acute angle defined by the top wall and the rear wall. The raised portion 18 defines a steam collection area which permits steam which rises from the hot beverage to rise and collect within the volume provided by spacing the top wall relatively substantially above the rip of the cup. The steam collection area decreases pressure formed within the substantially sealed cup when the lid is in place. The steam collection area also permits a space for the hot beverage to splash around in, such as when a cup of dispensed hot beverage is being carried. This steam collection area helps to reduce inadvertent spillage of the hot beverage past the rim of the cup, thereby causing burning or discomfort to the hand of the person carrying it.

Figure 8:
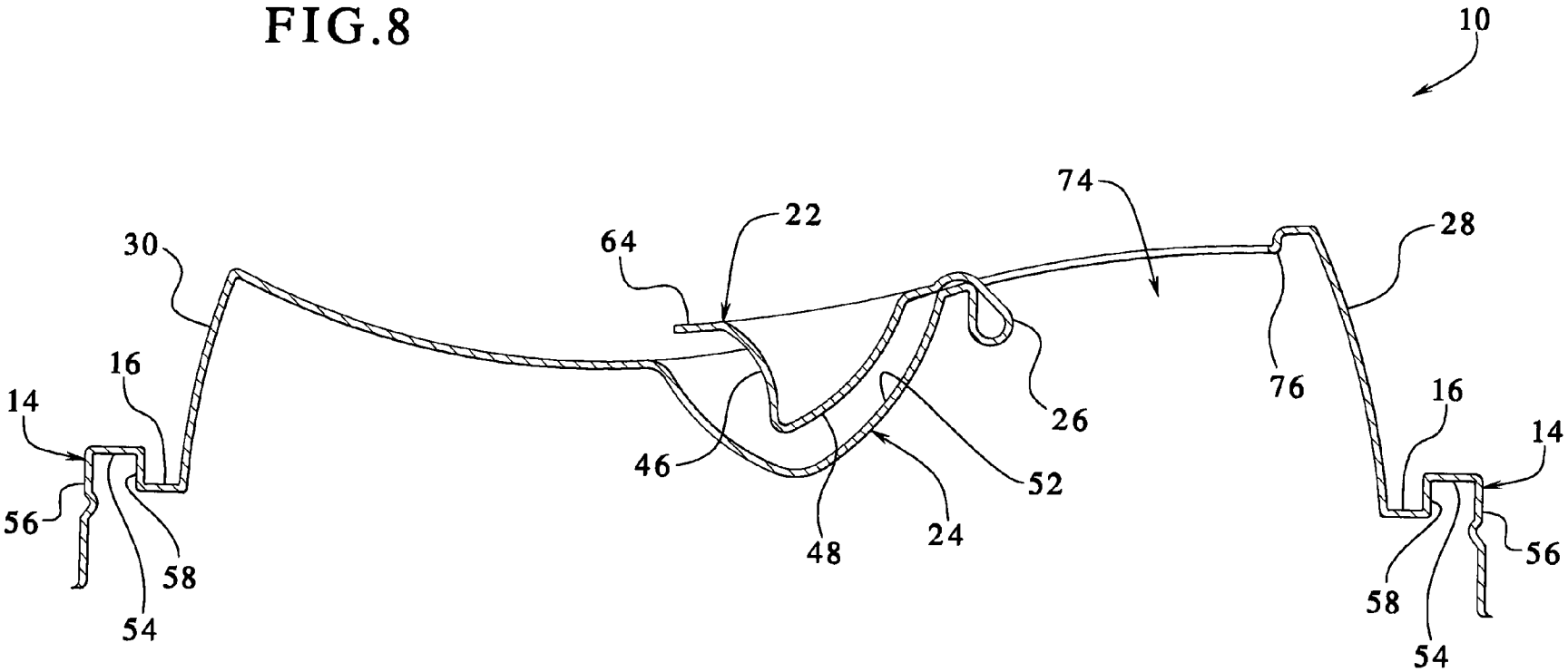
FIG. 8 is a cross-sectional view of the embodiment of the cup lid of FIG. 7, and illustrating the closure member in the open and locked position wherein the side walls of the gripping member engage the walls which define the locking recess.
Figure 10:
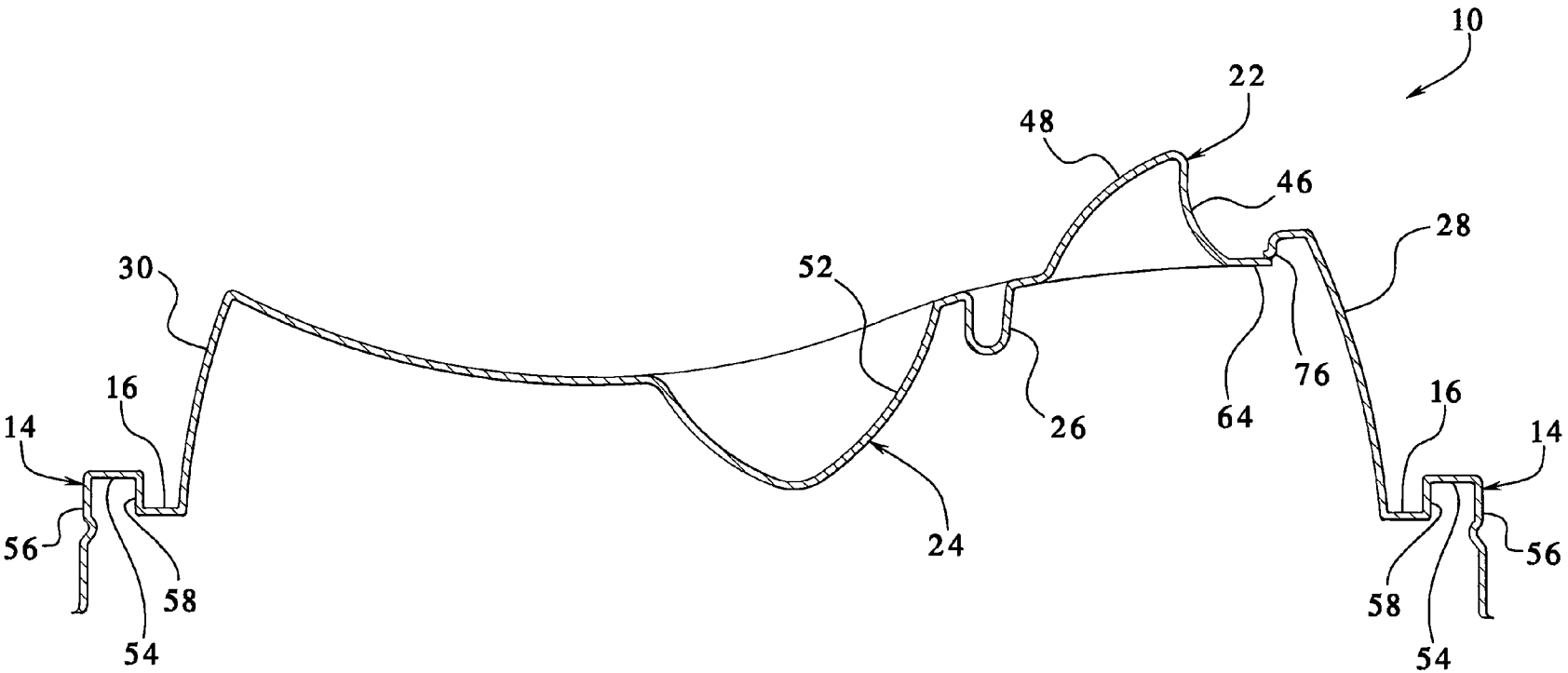
FIG. 10 is a cross-sectional view of the embodiment of the cup lid of FIG. 7, and illustrating the closure member in the re-closed position wherein the closure member covers the drink-through opening.

The top wall 34 of the raised portion 18 includes a front section, a central section and a rear section. The front section of the top wall (i.e., the closure member section) includes a movable closure member or tear-back flap 20. The closure member 20 is movable or pivotable about a depressed "U" shaped hinge 26 from an initial closed position (as illustrated in FIGS. 1, 2A, 3 and 7) to a locked open position (as illustrated in FIGS. 2B and 8). It should be appreciated that the hinge could be otherwise suitably formed or configured. The closure member 20 is further pivotable into a secured or locked closed position (as illustrated in FIG. 10). The front section of the top wall defines a drink-through opening 74 (best shown in FIG. 2B) which is exposed when the closure member 20 is in the open position. The closure member includes a gripping member 22 which extends upwardly from a base wall of the closure member. The central section of the top wall (i.e., the locking recess section) defines a locking recess 24 and the rear section of the top wall (i.e., the rear section) defines one or more branding zones or areas 60.

Figure 6:
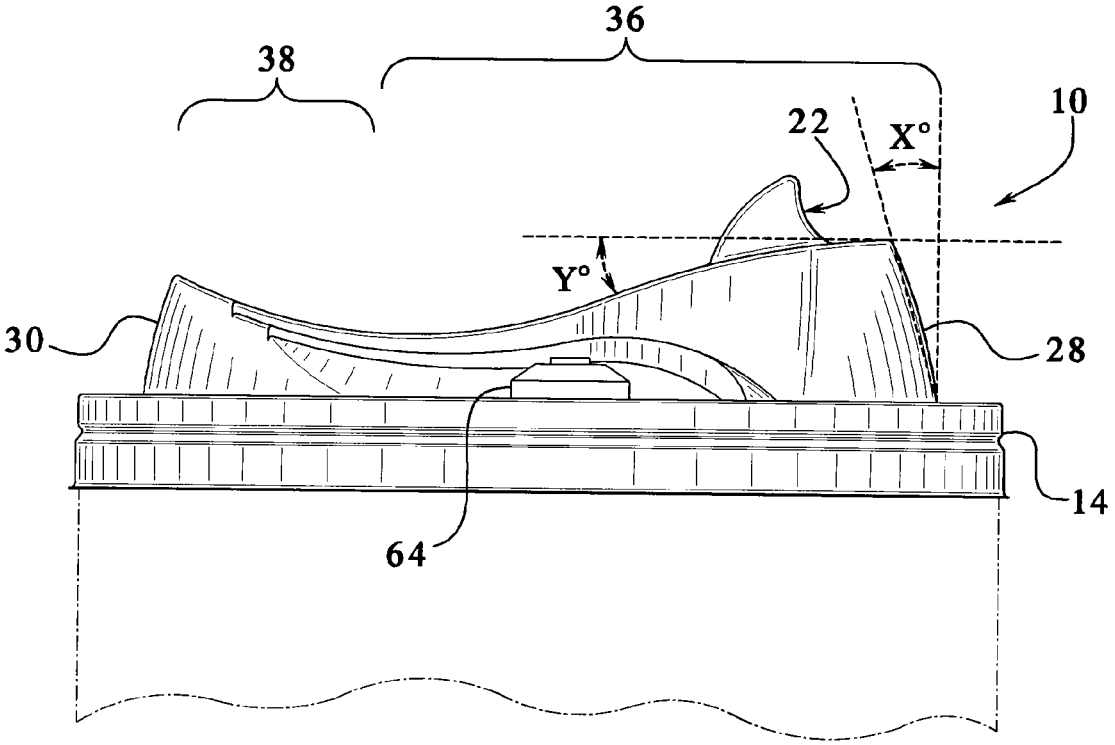
FIG. 6 is a side view of the embodiment of the cup lid illustrated in FIG. 1, and illustrating the contour of the clearance area and the enhanced drinking area.

As best seen in FIGS. 6 and 12, in one embodiment, the front section, central section and rear section of the top wall define a clearance area which is substantially concave in shape. Such a concave shape provides a suitable clearance to accommodate an average sized person's nose when the person is consuming the beverage in a cup having the lid positioned thereon. This concave shapes lessens the degree of tilt required in the person's neck by providing a space in which, when consuming the contents of the cup, a person's nose will extend into without contacting the top wall of the lid. This provides an enhanced drinking experience over other lids with top surfaces which lie substantially in a single horizontal plane and wherein a person's nose may contact the top surface of the lid when in one or more drinking positions.

In one embodiment, a front part of the clearance area defines an enhanced drinking area. The enhanced drinking area includes the closure member or tear-back flap 20 (including the gripping member 22) and the drink-through opening 74. It should be appreciated that the enhanced drinking area is curved or angled in multiple different planes. As best illustrated in FIGS. 1, 2A and 2B, a front portion of the enhanced drinking area includes the lip engaging front wall 28 which is angle, curved or convexly shaped in a first plane due to its annular or substantially annular shape. As best illustrated in FIG. 6, the lip engaging front wall 28 is also offset from a vertical or perpendicular plane at an angle in the range of greater than 0 degrees to 30 degrees (and in one preferred embodiment at an angle of approximately 21 degrees) and is thus angled, curved or convexly shaped in a second plane. Moreover, as best illustrated in FIGS. 1 and 6, the top wall 34 of the raised portion 18 which coincides with the enhanced drinking area is offset from a horizontal plane at an angle in the range of greater than 0 degrees to 45 degrees, and in one preferred embodiment at an angle of approximately 13.5 degrees. This configuration provides that the enhanced drinking area is suitably sloped such that the top of the lip engaging front wall 28 resides in a relatively higher plane than a central point of the drink-through opening.

The configuration of the enhanced drinking area of the lid 10 provides a more natural and less inhibited drinking experience for a person. For example, having a portion of the drink-through opening 74 closest to the lip engaging front wall 28 in a relatively higher plane than a portion of the drink-through opening further away from the lip engaging front wall 28 minimizes the amount of beverage that pools at or near the lip engaging front wall 28 when compared to a lid with a horizontal or substantially horizontal situated drink-through opening. Moreover, such a configuration provides that the angle in which the person's mouth interacts with the lid 10 is less than 90 degrees, thus enabling a person to place more of their mouth over the drink-through opening 74 to better simulate the experience of drinking from an uncovered cup or glass.

As seen in FIGS. 1 and 2, in one embodiment, the front section of the top wall (and the enhanced drinking area) includes the closure member or tear-back flap 20. A base of the closure member is defined by a "U" shaped hinge 26 formed in the top wall, first and second spaced apart perforated sides or edges 40*a* and 40*b* and a third perforated side or edge 42 (closest to the lip engaging front wall) which joins the outer ends of the first and second perforated sides or edges. As described above, the closure member is positioned such that the third perforated side 42 resides in a relatively higher plane than the "U" shaped hinge 26. This configuration minimizes or provides for little, if any, contact between a person's upper lip and the lid 10 to better simulate the experience of drinking from an uncovered cup or glass. This configuration further minimizes wrinkling when forming the cup lid.

When the closure member 20 is in the open position, the front section or closure member section of the top wall defines the drink-through opening 74 as generally shown in FIG. 2B. The hinge 26, the two spaced apart perforated sides or edges 40*a* and 40*b* and the third perforated side or edge 42 define the periphery of the drink-through opening when the closure member is in the open position.

In one embodiment, the gripping member 22 which extends upwardly from the base of the closure member includes two spaced apart side walls 44*a* and 44*b*, a concave shaped thumb engaging member 46 and a convex shaped finger engaging member 48. The gripping member 22 is suitably shaped to allow a person's thumb and finger to engage the thumb engaging member 46 and the finger engaging member 48, respectively, to catch and lift the gripping member 22 (and the connected closure member 20). In alternative embodiments, the gripping member 22 may be otherwise suitably shaped based on specific design specifications. For example, any side of the gripping member may be concavely or convexly shaped to be gripped by a person's hand. It should be appreciated that when compared to gripping members of known lids (i.e., which sit in a horizontal or substantially horizontal plane), the configuration of the enhanced drinking area of the lid (i.e., positioning the gripping member at an appropriate angle relative to or intersecting the horizontal lid or rim of the cup), provides a person with increased leverage when lifting the gripping member and the closure member.

As seen in FIGS. 1 and 2, in one embodiment, the central section of the top wall 34 defines the locking recess 24. The locking recess 24 resides in a relatively lower plane than the closure member 22 and the "U" shaped hinge 26. The locking recess 24 is defined by two spaced apart side or locking walls 50*a* and 50*b* and a concave shaped bottom wall or floor 52. In one embodiment, the side walls of the locking recess are suitably arranged such that the distance between the side walls of the locking recess decreases in a direction toward the bottom wall of the locking recess. In this embodiment, at the top of the locking recess, the distance between the side walls 50*a* and 50*b* of the locking recess 24 is greater than the distance between the side walls 44*a* and 44*b* of the gripping member 22. Moreover, in this embodiment, at a designated distance from the bottom wall of the locking recess, the distance between the side walls 50*a* and 50*b* of the locking recess 24 is equal to or less than the distance between the side walls of the gripping member. Such recess sidewall configuration provides suitable engagement surfaces between the gripping member 22 and the locking recess 24 as further described below. In another embodiment, the side walls of the locking recess sit in a vertical or substantially vertical plane such that the distance between the side walls of the locking recess remains unchanged in a direction toward the bottom of the locking recess. In another embodiment, the floor of the locking recess 24 defines one or more apertures or venting holes 68 which allow steam to escape from the cup and any liquid which may have escaped the cup and pooled in the locking recess to flow back into the cup. In another embodiment, any suitable area of the top wall defines one or more venting holes.

As seen in FIGS. 1, 2A, 2B and 6, in one embodiment, the rear section of the top wall is offset from a horizontal plane at a suitable angle in the range of greater than 0 degrees to 60 degrees, and in one preferred embodiment at an angle of approximately 15 degrees. Moreover, the rear section of the top wall includes one or more branding zones or areas 60 where suitable indicia, such as a company's logo, may be placed or stamped onto the disposable lid. Compared to known lids with indicia stamped on the planar top surface (which are generally viewed from a position substantially above the indicia), placing the indicia at a suitable angle relative to a perpendicular plane provides that such indicia is more easily viewed when the lid is situated on a cup sitting on a horizontal plane, such as on a table. Additionally, stamping the indicia at a suitable angle provides that the indicia may be more easily viewed when a person is drinking from a cup with the lid attached. In alternative embodiments, based on specific design specifications, indicia may be placed onto one or more different areas of the disposable lid. For example, indicia may also be placed or stamped on the lip engaging front wall 28, the rear wall 30 or the side walls which define the raised portion.

As illustrated in FIG. 7, in one embodiment, the annular cup mounting portion 14 of the lid 10 includes a downwardly facing cup rim engaging recess 54 which extends all around the periphery of the body and is adapted to receive a corresponding rim of a drinking cup. The cup rim engaging recess is defined at its outer side by an apron 56 and at its inner side by a downwardly directed recess side wall 58. The cup rim engaging recess assures that the disposable lid may be securely attached to a drinking cup.

In one embodiment, the floor 16 of the body 12, the downwardly directed recess sidewall of the mounting portion 58 and one or more of the walls of the raised portion 18 define an annular channel 62. The annular channel readily receives any fluid which may drip down the side wall, flow out of any openings of the lid when the container is jarred or which may built up during consumption of the beverage in the cup. The annular channel is preferably significant in size to accommodate more than just a few droplets of fluid.

In one embodiment, the lid 10 includes one or more raised offsets 64 which extend from the body 12 of the lid 10. The raised offsets are each adapted to be punched out to indicate the specific contents in the cup, such as the type of beverage in the cup. In one embodiment, the lid includes one or more steps 66 adjacent to the side walls 32 of the raised portion 18. Each step includes a sidewall 70 extending from the floor 16 of the body 12 and a top wall 72 connected to the top edge of the sidewall. In addition to providing additional support or rigidity to the entire body, the top walls of these steps provide an area in which indicia may be placed or stamped.

In operation, when a person applies pressure to the gripping member 22 of the lid 10, the perforated areas of the front section of the top wall fracture to allow the closure member 20 to partially separate from the raised portion 18 along the perforations. The gripping member 22 and closure member 20 are then rotated or folded back about the "U" shaped hinge 26 until the gripping member engages the locking recess 24. With the closure member folded back, the body defines the drink-through opening 74 as described above and best seen in FIG. 2B. It should be appreciated that until a person applies pressure to fracture the perforations to allow the closure member to partially separate from the raised portion along the perforations, the closure member will remain in the initial closed position and thus the lid forms a seal over the open end of a drinking cup. Such a configuration allows for the safe and sealed transportation of the beverage contained within the cup.

In one embodiment, the width of the space between the first and second sides of the closure member (which generally coincides with the width between the first and second sides or edges of the drink-through opening) is greater than the width of the third perforated side of the closure member (which coincides with the width of the side or edge of the drink-through opening closest to the lip engaging front wall). In this embodiment, the first and second perforated sides of the closure member are suitably shaped such that the width of the closure member narrows as the closure member extends in the direction of the third perforated side or edge. Such a configuration provides that when the closure member is removed and the drink-through opening is revealed, the drink-through opening is suitably shaped such that the width of the opening narrows as the opening approaches the lip engaging surface. This narrowing shape of the drink-through opening funnels more of the beverage into the center of the person's or drinker's mouth and thus provides an enhanced drinking experience. It should be appreciated that any suitable shape for the drink-through opening may be employed based on specific design specifications.

In another embodiment, in addition to providing a suitable shape to funnel the beverage into the center of the person's mouth, the drink-through opening 74 is suitably shaped and sized to provide an opening large enough to enable a person to add one or more condiments or flavoring ingredients such as milk, cream and sugar, to the beverage through the drink-through opening without requiring the person to remove the lid, thus reducing the chances that the beverage in the cup may be spilled. This is generally illustrated in FIG. 2B and in FIG. 8.

Figure 13:
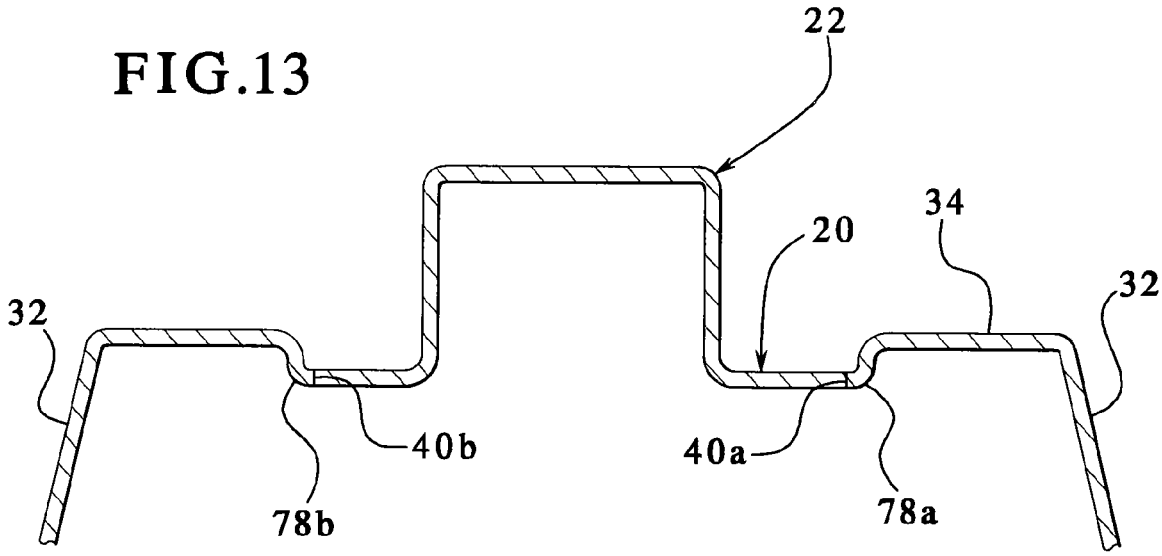
FIG. 13 is a cross-sectional side view of one embodiment of the cup lid taken substantially through line 13-13 of FIG. 2A, and illustrating the beveling of the top wall adjacent to the edges which define the closure member.

As illustrated in FIGS. 7, 8, 10 and 13, in one embodiment, when the closure member 20 is folded back to reveal the drink-through opening, the two spaced apart perforated sides 40*a* and 40*b* and the third perforated side 42 which define the closure member may present sharp points (not shown) which may irritate the lower lip and/or tongue of the person. Accordingly, in one embodiment, the top wall is suitably beveled adjacent to the front edge 76 (as best seen in FIGS. 7, 8 and 10) and side edges 78*a* and 78*b* (as best seen in FIG. 13) of the closure member. Such beveling provides that the base of the closure member resides in a lower plane than the top wall adjacent to the closure member and thus, when the closure member is in the open position to expose the drink-through opening, any contact between the person's lower lip and/or tongue and the edges of the drink-through opening is minimized. Moreover, in one embodiment, the third perforated side 42 of the closure member 20 (i.e., the side or edge closest to the lip engaging front wall) is spaced apart from the front lip engaging front wall 28 to further minimize contact between the person's lower lip and/or tongue and the edges of the drink-through opening.

Figure 9:
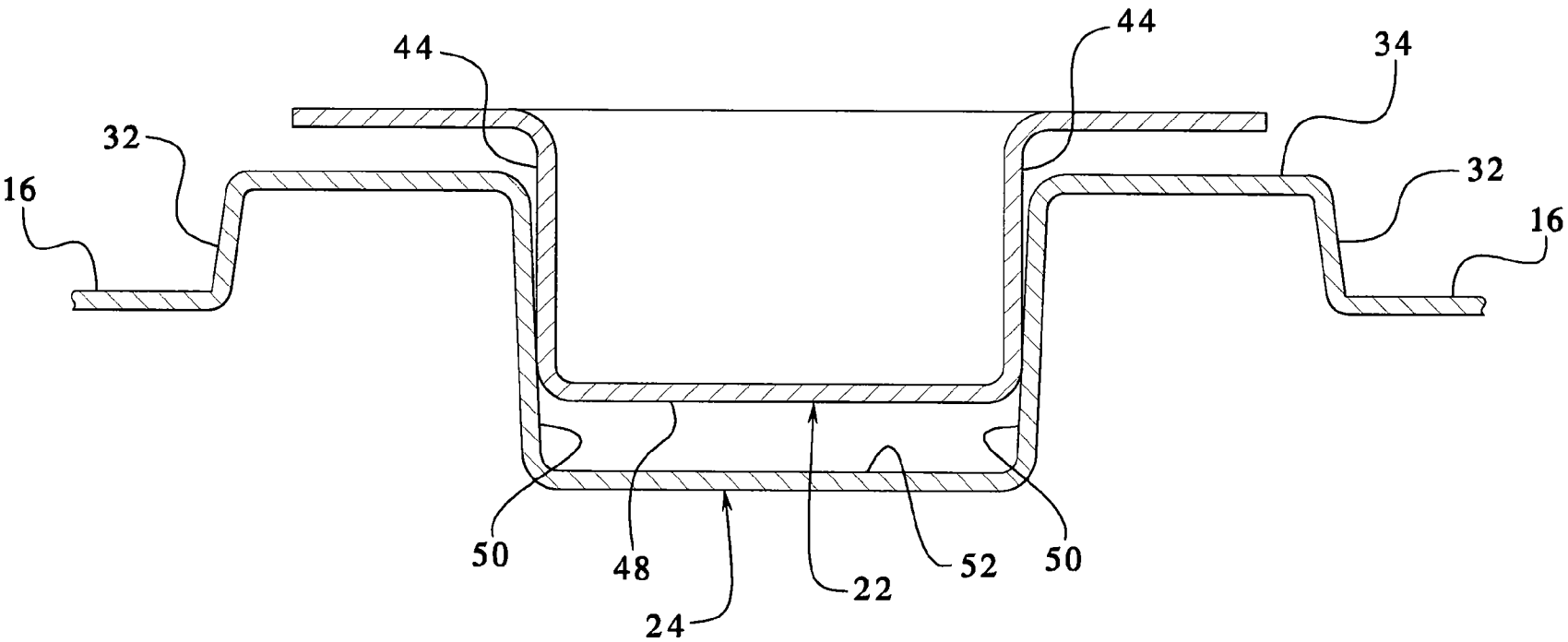
FIG. 9 is a fragmentary cross-sectional view of one embodiment of the cup lid taken substantially through line 9-9 of FIG. 2B, and illustrating the side walls of the gripping member frictionally engaging the walls which define the locking recess.

As illustrated in FIGS. 8 and 9, when the gripping member 22 engages the locking recess 24, the finger engaging member 48 engages the concave bottom wall 52 of the locking recess 24 and the side walls of the locking recess 50*a* and 50*b* frictionally engage the side walls 44*a* and 44*b* of the gripping member 22. As described above, this engagement is caused by the outward angling of the side walls of the locking recess to define a width between such side walls which, at a designated distance from the floor of the locking recess, is equal to or less than the width between the side walls of the gripping member. This frictional engagement insures that the gripping member remains secured in the locking recess and thus the closure member remains in the open position.

In another embodiment, the length of the bottom wall 52 of the locking recess 24 is greater than the length of the finger engaging member 48 of the gripping member 22. In this embodiment, when the gripping member engages the locking recess, a space is defined between the front edge of the gripping member (i.e., the finger engaging member) and the rear portion or back end of the floor of the locking recess. This space provides an area in which a person may grip the front edge of the gripping member and generate enough leverage to remove the gripping member from the locked position to fold the gripping member (and connected closure member) about the "U" shaped hinge to reclose the closure member.

As illustrated in FIG. 10, in one embodiment, after the perforations have been fractured and the closure member has been folded back about the hinge 26, an outward marginal edge portion 64 of the closure member extends outwardly beyond the third perforated side 42 in the raised portion 18 of the body 12. In this embodiment, when the closure member is rotated to a closed position, this marginal edge of the closure member engages the bottom surface of the top wall 34 of the raised portion to lock the closure member in the secured or locked closed position as described above.

In another embodiment, the rear wall is curved, annular or radiused in the horizontal direction and in a vertical direction or otherwise suitably shaped to conform with design specifications. In one embodiment, one or more of the side walls which extend from the floor to define the raised portion are vertical or substantially vertical. In another embodiment, one or more of the side walls of the raised portion are suitable curved, annular or angled in a horizontal direction and/or in a vertical direction. In one embodiment, the spaced apart side walls of the raised portion are curved or otherwise suitably shaped based on specific design specifications.

In alternative embodiments, the top wall of the front, central and/or rear sections of the raised portion may be suitably concavely shaped, suitably convexly shaped or shaped in any other suitable configuration. In another embodiment, the wall of the raised portion of the body extends upwardly from the floor of the body at a suitable angle offset from a perpendicular plane at an angle in the range of greater than 0 degrees to 30 degrees.

In one embodiment, the closure member (and thus drink-through opening) is shaped such that at one point on the closure member, the width of the closure member (and drink-through opening) is greater than the length of the "U" shaped hinge and at another point on the closure member which is closer to the lip engaging front wall 28 the width of the closure member (and drink-through opening) narrows as described above. For example, the closure member (and drink-through opening) are suitably shaped to define projecting ears along the sides of the closure member (and the drink-through opening).

Figure 14A:
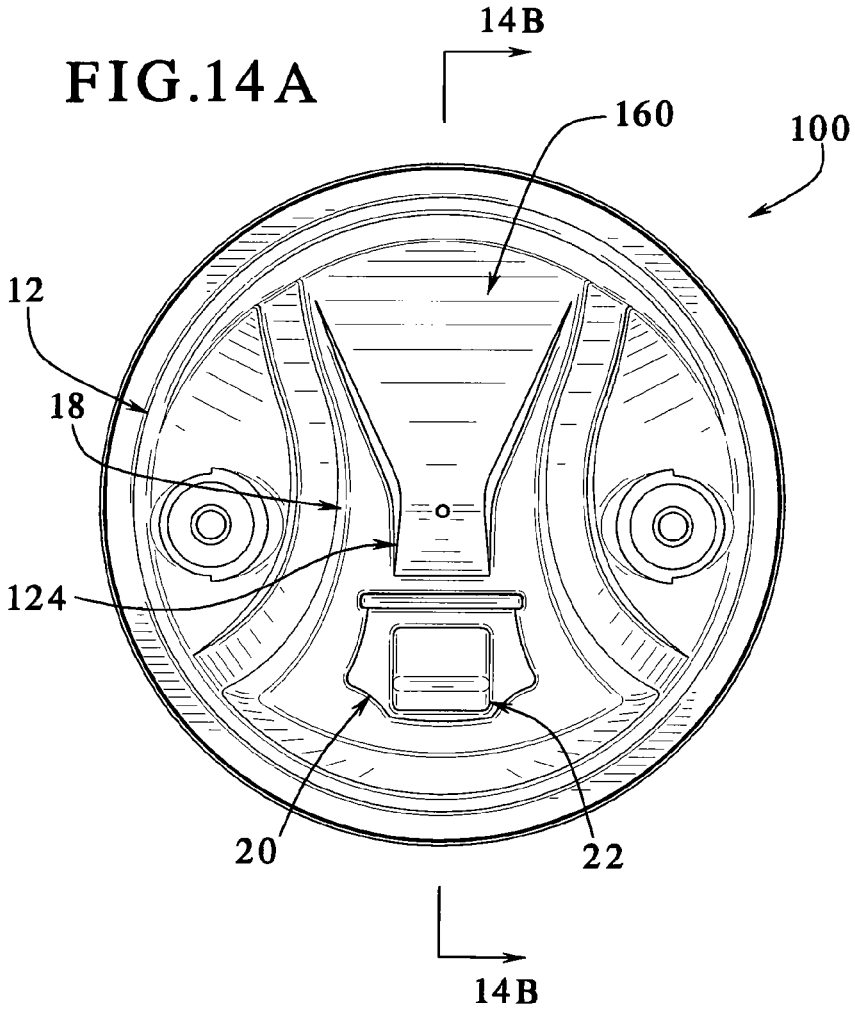
FIG. 14A is a top plan view of an alternative embodiment of the cup lid, and illustrating an alternative configuration of a locking recess.
Figure 14B:
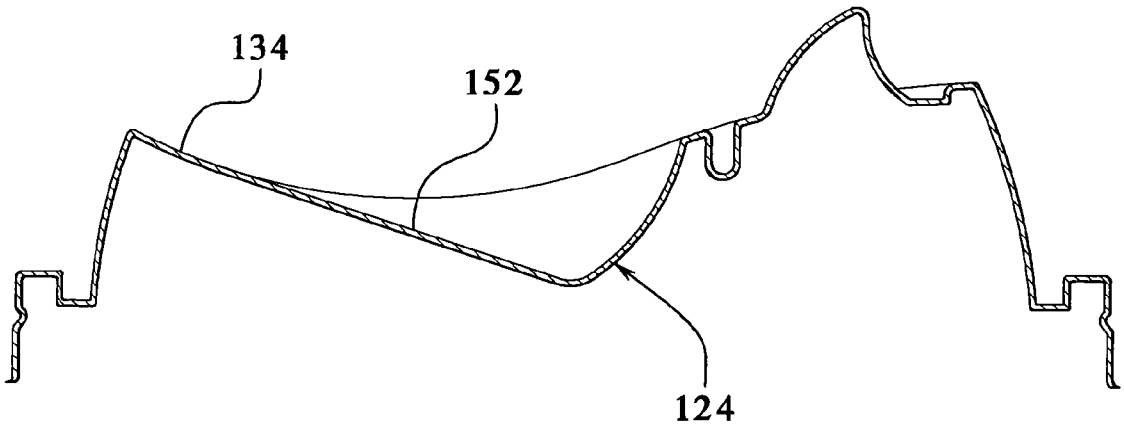
FIG. 14B is a cross-sectional side view of the alternative embodiment of the cup lid taken substantially through line 14B-14B of FIG. 14A.

In an alternative embodiment, as illustrated in FIGS. 14A and 14B, the floor 152 of the locking recess 124 of this cup lid 100 may extend into and form the rear section of the top wall 134. It should be appreciated that the locking recess may have any suitable shape, size or other configuration based on specific design specifications.

In another embodiment, rather than securing the partially removed closure member for subsequent closings of the revealed drink-through opening, the closure member is completely removed from the lid and may be discarded.

Another embodiment of the disclosed lid having certain similar features and functions to those described above is illustrated in FIGS. 15, 16, 17 and 18. This illustrated alternative embodiment lid 210, similar to as described above, includes, amongst other elements:

(a) a body 212;
(b) an annular mounting portion 214;
(c) a floor or base 216; and
(d) a raised portion 218 which includes:
  (i) a lip engaging front wall 228;
  (ii) a rear wall 230;
  (iii) two spaced apart annular side walls 232; and
  (iv) a top wall 234 including a movable closure member 220 (including a gripping member 220), a depressed "U" shaped hinge 226 and a locking recess 224.

Figure 15:
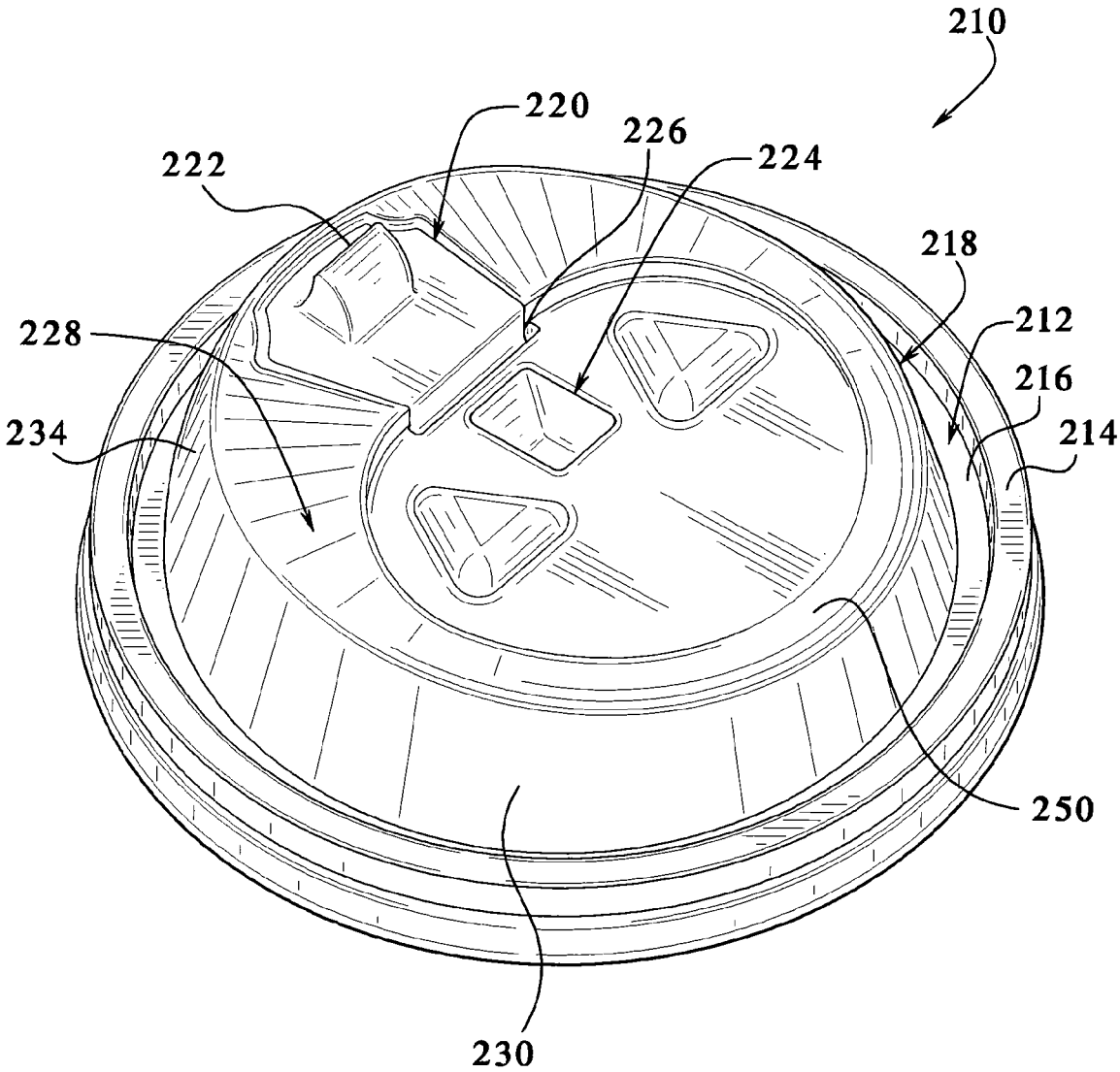
FIG. 15 is a rear perspective view of one alternative embodiment of the disclosed cup lid.
Figure 16:
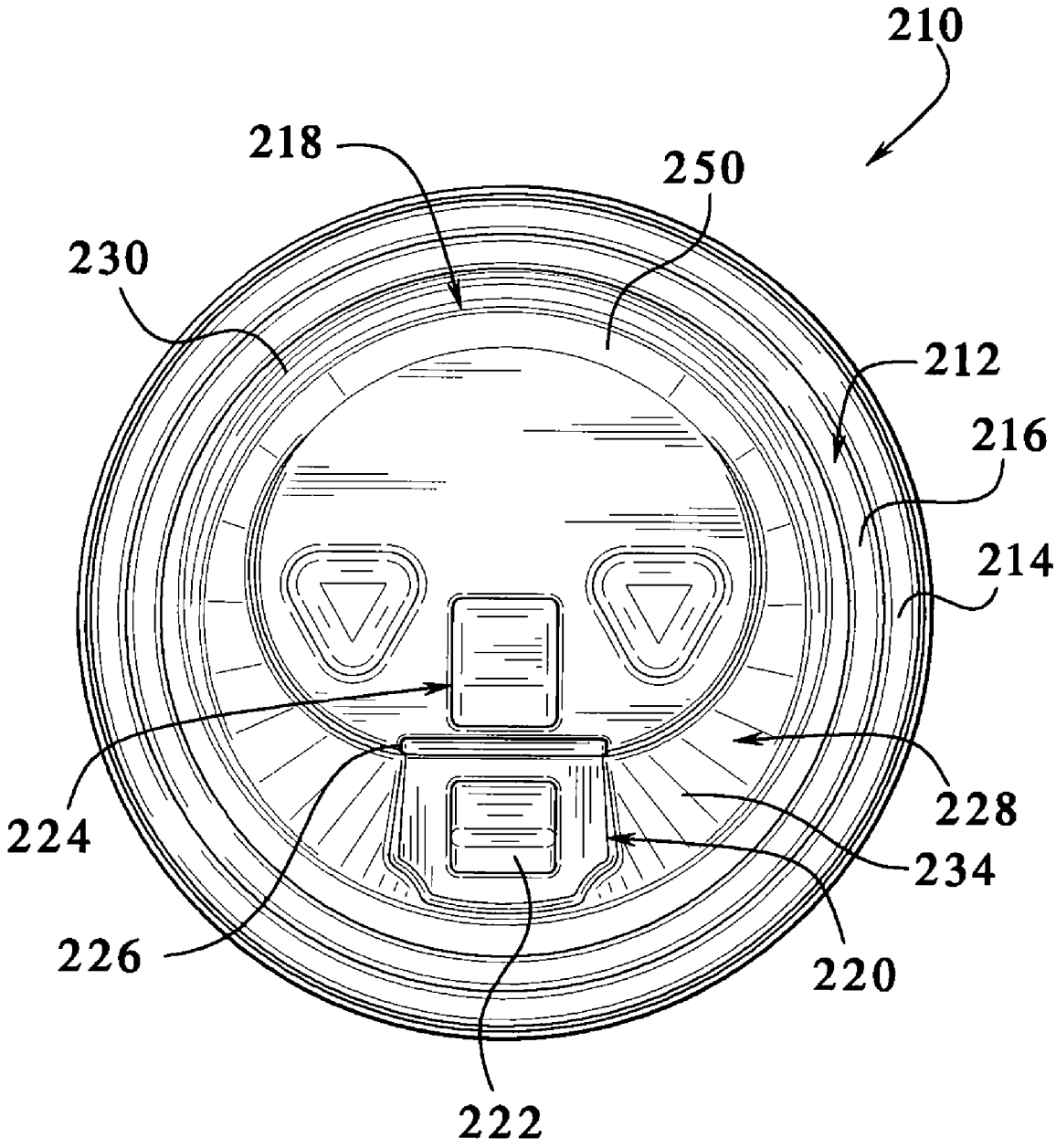
FIG. 16 is a top plan view of the alternative embodiment of the cup lid of FIG. 15, and illustrating the closure member in an initially closed position.
Figure 17:
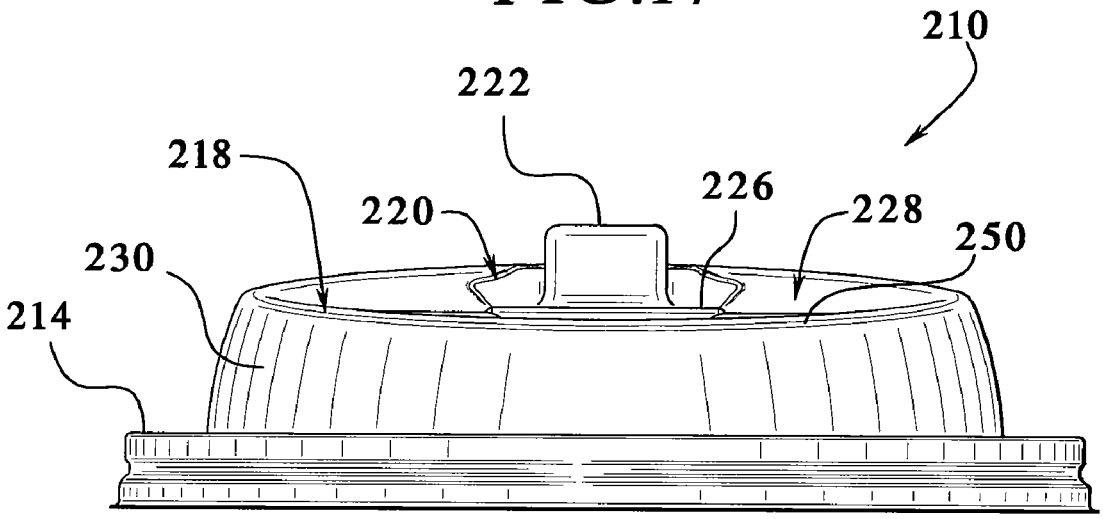
FIG. 17 is a rear side view of the alternative embodiment of the cup lid illustrated in FIG. 15.
Figure 18:
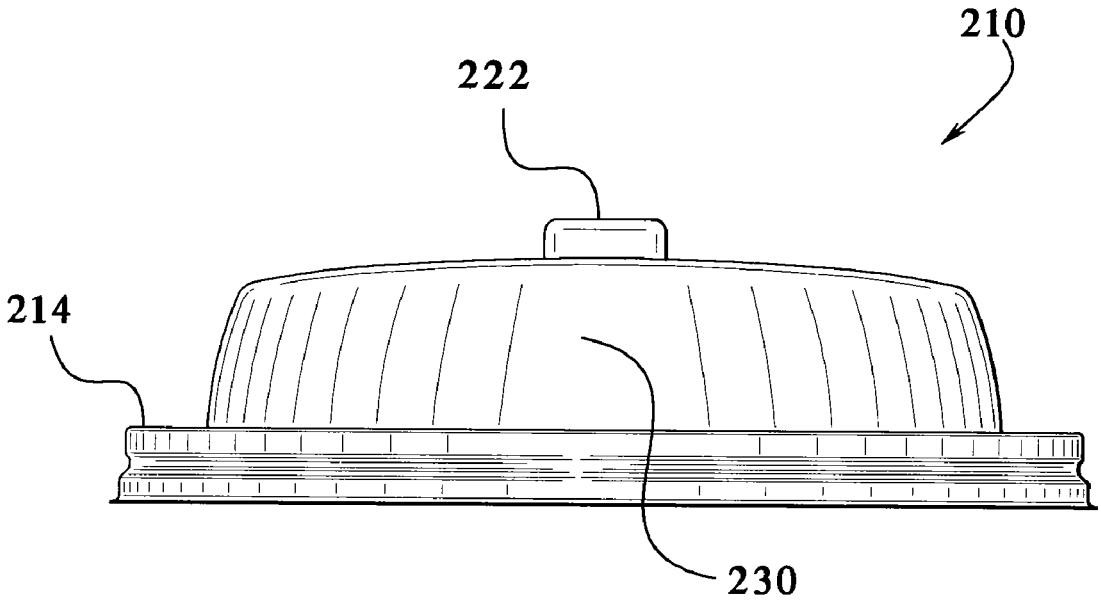
FIG. 18 is a front side view of the alternative embodiment of the cup lid illustrated in FIG. 15.

As seen in FIGS. 15 and 16, in this alternative embodiment, part or all of the central and rear sections of the top wall are flat or substantially flat. In this embodiment, part or all of the central and rear sections of the top wall reside in a horizontally extending or substantially horizontally extending plane (which is relatively lower than the angled plane which the front section of the top wall resides in). In another embodiment, the central and rear sections of the top wall reside in a horizontally extending plane or substantially horizontally extending plane which is lower than a top end of the annular side walls which define the raised portion.

As also seen in FIGS. 15 and 16, in this embodiment, the body of the lid defines an annular shoulder 250 connecting the side ends of the central and rear sections of the top wall to the top end of the annular side walls which define the raised portion. In one such embodiment, the shoulder is angled offset from a horizontally extending plane. Such a shoulder provides one or more branding zones or areas where suitable indicia may be placed or stamped. It should be appreciated that in this embodiment, the hinge 226 is aligned with the annular shoulder 250 and situated at the bottom end of the shoulder. Such a configuration provides a person with increased leverage when lifting the closure member about the hinge.

In one embodiment, the lid is disposable and vacuum and pressure formed from any suitable plastics material, such as, extruded polystyrene or polypropylene. In this embodiment, a thin sheet of the plastics material is extruded, reheated and conveyed into a vacuum/pressure molding station where the plastics material is vacuum/pressure molded using male or female cavities or molds. The plastic sheet material is permitted to cool for a brief period of time and then stripped from the cavity or mold. After the web or sheet material has been stripped from the cavity or mold, the web or sheet material is conveyed to a trimming station where perforated fault lines are stamped in the lid to define the closure member or tear-back flap.

In one embodiment, the body of the lid is positioned relative to a cutting edge of a cutting member such that the floor of the body resides in a first plane or along a first axis, the closure member section of the top wall of the body resides in a second plane or along a second axis (which as described above, intersects the first plane) and the cutting edge extends in a third plane or along a third axis which is substantially parallel to the second plane. In this embodiment, the cutting edge of the cutting member are used to stamp or form a plurality of perforated lines in the closure member section to define part of a closure member. It should be appreciated that the cutting edge of the cutting member is suitably shaped to stamp or form a plurality of perforated lines in a plurality of different directions (as seen by perforated lines 40*a*, 40*b* and 42 of FIG. 1).

Figure 11A:
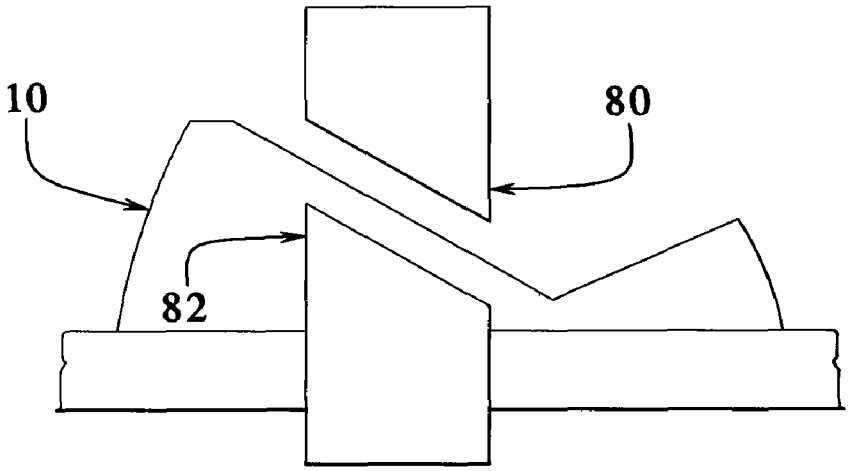
FIGS. 11A and 11B are a series of elevational views illustrating methods of forming the perforated lines for the closure member in the lid.

In one embodiment, as seen in FIG. 11A, if the pre-stamped lid sits in a substantially horizontal plane, then the blade 80 and corresponding strike plate 82 which are used to stamp the perforated lines must be suitably angled to correspond with the angle of the first section of the raised portion. That is, the blade and corresponding strike plate are situated at an angle parallel to the angle of the first section of the raised portion of the cup lid. In one such embodiment, the method of manufacturing a disposable cup lid which is attachable to a drinking cup includes forming a body including a floor and a raised portion, wherein the floor extends in a first plane and the raised portion extends from the floor. The body includes a lip engaging front wall, a rear wall, a plurality of spaced apart side walls connected to the lip engaging front wall and the rear wall, and a top wall connected to the lip engaging front wall, the side walls, and the rear wall, the top wall including a closure member section extending in a second plane which intersects the first plane. After forming the body, this embodiment includes positioning the body relative to a cutting edge of a cutting member such that the first plane extends horizontally or substantially horizontally, the second plane extends offset from a horizontal or substantially horizontal plane at an angle in a range of greater than zero degrees to forty-five degrees and the cutting edge extends in a third plane substantially parallel to the second plane. This embodiment also includes causing the cutting edge to form a plurality of perforated lines in the closure member section to define part of a closure member.

Figure 11B:
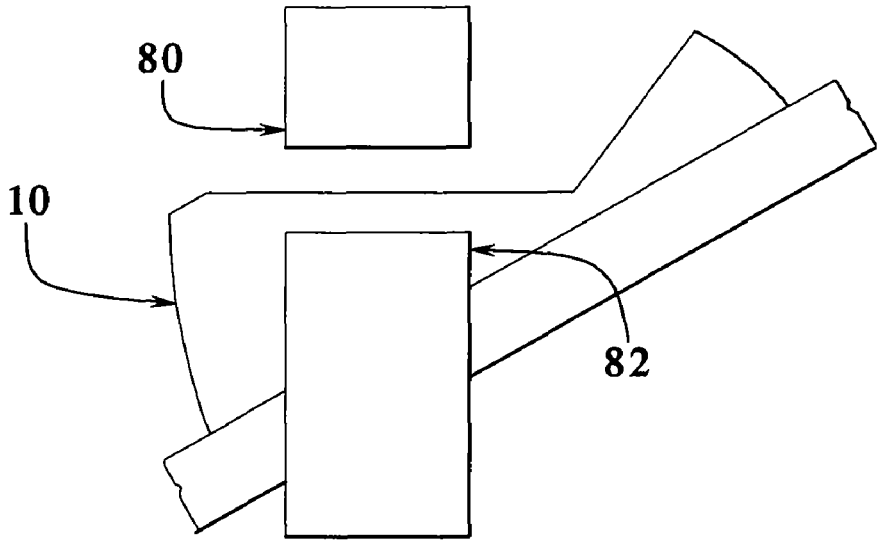

In another embodiment, as seen in FIG. 11B, if the pre-stamped lid is situated at an angle which corresponds with the angle of the first section of the raised portion, then a substantial horizontal blade and corresponding horizontal strike plate may be used to stamp the perforated lines into the lid. In one such embodiment, the method of manufacturing a disposable cup lid which is attachable to a drinking cup includes forming a body including a floor and a raised portion, wherein the floor extends in a first plane and the raised portion extends from the floor. The body includes a lip engaging front wall, a rear wall, a plurality of spaced apart side walls connected to the lip engaging front wall and the rear wall, and a top wall connected to the lip engaging front wall, the side walls, and the rear wall, the top wall including a closure member section extending in a second plane which intersects the first plane. After forming the body, this embodiment includes positioning the body relative to a cutting edge of a cutting member such that the first plane extends offset from a horizontal or substantially horizontal plane at an angle in a range of greater than zero degrees to forty-five degrees, the second plane extends horizontally or substantially horizontally and said cutting edge extends in a third plane substantially parallel to the second plane. This embodiment also includes causing the cutting edge to form a plurality of perforated lines in the closure member section to define part of a closure member.

It should be appreciated that at the same time or in a separate cutting step, the web or sheet material is stamped so as to cut or trim the lids from the sheet material and also to cut any venting holes 68 into the lid. Although described herein as a disposable single use lid, it should be appreciated that the lid may be manufactured for multiple uses.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A disposable cup lid attachable to a drinking cup, said disposable cup lid comprising:

a body including a floor extending in a first plane and a raised portion extending from the floor, said raised portion including:

an arcuate lip engaging front wall, a rear wall, a plurality of spaced apart side walls connected to the lip engaging front wall and the rear wall, and a top wall connected to the lip engaging front wall, the side walls, and the rear wall, said top wall extending downward from a top of the lip engaging front wall at a first acute angle relative to a plane parallel with the first plane and said top wall extending downward from a top of from said rear wall at a second different angle, wherein said top wall includes a closure member section including a closure member defined by a hinge and first and second spaced apart edges, a first end of the first edge of said closure member which is opposite of the hinge extends from the floor a greater distance along a first line which is perpendicular to the first plane than a distance that a second, opposite end of said first edge of said closure member which is adjacent to the hinge extends from the floor along a second line which is perpendicular to the first plane; and a cup mounting portion extending around a periphery of the body.

2. The disposable cup lid of claim 1, wherein the closure member is also defined by a third edge which joins the first end of the first edge and a first end of the second edge which is opposite of the hinge.

3. The disposable cup lid of claim 2, wherein a drink-through opening is configured to be accessible by tearing back said closure member up to said hinge and folding back said closure member about said hinge.

4. The disposable cup lid of claim 3, wherein the third edge which defines the closure member has a length less than a width between the first and second spaced apart edges which define the closure member.

5. The disposable cup lid of claim 1, wherein the top wall includes a locking recess section that defines a locking recess including two spaced apart side walls and a locking recess floor.

6. The disposable cup lid of claim 5, wherein the spaced apart side walls of the locking recess extend from the top wall toward the locking recess floor and toward each other.

7. The disposable cup lid of claim 1, wherein the closure member section of the top wall and the lip engaging front wall define a steam collection area under the top wall.

8. The disposable cup lid of claim 1, wherein the lip engaging front wall is curved in two different planes.

9. A disposable cup lid attachable to a drinking cup, said disposable cup lid comprising:

a body including a floor and a raised portion, said floor extending in a first plane, said raised portion extending from the floor and including:

a lip engaging front wall, a rear wall, a plurality of spaced apart side walls connected to the lip engaging front wall and the rear wall, and a top wall connected to the lip engaging front wall, the rear wall and the spaced apart side walls, wherein the top wall includes:

a closure member section extending in a second plane which intersects the first plane, wherein said closure member section of the top wall includes a closure member defined by a hinge, and first and second spaced apart edges, a first end of the first edge which is adjacent to the lip engaging front wall extends from the floor a greater distance along a first line which is perpendicular to the first plane than a distance that a second opposite end of the first edge which is adjacent to the hinge extends from the floor along a second line which is perpendicular to the first plane, and a rear section extending in a third plane which is parallel to the first plane; and a cup mounting portion extending around a periphery of the body.

10. The disposable cup lid of claim 9, wherein the raised portion includes a shoulder connecting a top end of the side walls and a top end of the rear wall to a side end of the top wall.

11. The disposable cup lid of claim 9, wherein the top wall extends from a top of the rear wall at a right angle.

12. The disposable cup lid of claim 9, wherein said closure member is also defined by a third edge which joins the first end of the first edge and a first end of the second edge which is opposite of the hinge.

13. The disposable cup lid of claim 12, wherein a drink-through opening is configured to be accessible by tearing back said closure member up to said hinge and folding back said closure member about said hinge.

14. The disposable cup lid of claim 9, wherein the top wall includes a locking recess section positioned between the closure member section and the rear section.

15. The disposable cup lid of claim 14, wherein said locking recess section of the top wall defines a locking recess which includes two spaced apart side walls and a locking recess floor.

16. The disposable cup lid of claim 15, wherein the spaced apart side walls of the locking recess extend from the top wall toward the locking recess floor and toward each other.

17. The disposable cup lid of claim 9, wherein the closure member section of the top wall and the lip engaging front wall define a steam collection area under the top wall.

18. The disposable cup lid of claim 9, wherein the lip engaging front wall is curved in two different planes.

19. The disposable cup lid of claim 9, wherein the first plane extends horizontally or substantially horizontally.

* * * * *